US005943080A

United States Patent [19]

Kubota et al.

[11] Patent Number: 5,943,080

[45] Date of Patent: Aug. 24, 1999

[54] INK-JET RECORDING METHOD

[75] Inventors: Hidemi Kubota, Komae; Isao Kimura, Kawasaki; Hiroyuki Maeda, Yokohama, all of Japan

[73] Assignee: Canon Kabushiki Kaisha, Tokyo, Japan

[21] Appl. No.: 08/677,355

[22] Filed: Jul. 5, 1996

[30] Foreign Application Priority Data

Jul. 7, 1995 [JP] Japan ..... 7-194035

[51] Int. Cl.[6] ..... B41J 2/05

[52] U.S. Cl. ..... 347/100; 526/260; 526/258

[58] Field of Search ..... 347/100, 99, 57; 526/260, 258

[56] References Cited

U.S. PATENT DOCUMENTS

| | | | |
|---|---|---|---|
| 4,246,154 | 1/1981 | Yao | 260/29.6 |
| 4,313,124 | 1/1982 | Hara | 347/57 |
| 4,345,262 | 8/1982 | Shirato | 347/57 X |
| 4,680,332 | 7/1987 | Hair et al. | 524/377 |
| 4,723,129 | 2/1988 | Endo | 347/57 X |
| 5,100,471 | 3/1992 | Winnik et al. | 106/23 |
| 5,439,515 | 8/1995 | Kurabayashi et al. | 106/20 R |
| 5,462,591 | 10/1995 | Karandikar | 347/99 X |
| 5,606,356 | 2/1997 | Noguchi | 347/100 |
| 5,854,307 | 12/1998 | Kimura et al. | 523/161 |

FOREIGN PATENT DOCUMENTS

| | | | |
|---|---|---|---|
| 0 329 026 A1 | 8/1989 | European Pat. Off. | C09D 11/00 |
| 0 618 278 A2 | 10/1994 | European Pat. Off. | C09D 11/00 |
| 58-13675 | 1/1983 | Japan | C09D 11/00 |
| 62-181372 | 8/1987 | Japan | C09D 11/00 |
| 63-23981 | 2/1988 | Japan | C09D 11/00 |
| 1-272623 | 10/1989 | Japan | C08G 59/40 |
| 03-065345 | 3/1991 | Japan | B41J 2/01 |
| 3-172362 | 7/1991 | Japan | C09D 11/00 |
| 3-240586 | 10/1991 | Japan | B41M 5/00 |
| 4-109040 | 4/1992 | Japan | F02D 29/02 |
| 5-31905 | 2/1993 | Japan | B41J 2/05 |
| 6-9848 | 1/1994 | Japan | C08L 33/14 |
| 6-49399 | 2/1994 | Japan | C09D 11/00 |

OTHER PUBLICATIONS

Croucher, et al., "Design Criteria and Future Directions in Inkjet Ink Technology," Ind. Eng. Chem. Res., vol. 28, No. 11, pp. 1712–1718 (1989).

*Primary Examiner*—Joseph Hartary

*Attorney, Agent, or Firm*—Fitzpatrick, Cella, Harper & Scinto

[57] ABSTRACT

An ink-jet recording method comprises actuating a heating element which is in contact with an ink in a recording head, in response to a recording signal, to heat the ink thereby creating bubbles in the ink and thus ejecting ink droplets from the head so that recording is effected with the ink droplets. The ink is a liquid having a property such that its viscosity changes abruptly when heated and the heating element generates heat so that the average heat flux $q_o$ from the surface of the heating element to the ink satisfies the condition represented by the following formula:

$$q_o \leq \frac{\alpha\kappa\pi S(T_B - T_o)^2}{4V(T_P - T_o)}$$

where κ denotes the coefficient of thermal conductivity of the ink, S the effective area of the heating element, V the volume of ink droplets ejected by one driving operation, $T_B$ the temperature of the ink at which bubbles are created in the ink, $T_o$ the temperature of the ink before the ink is ejected, $T_P$ the transition temperature of the ink at which the abrupt change in the viscosity occurs, and a the correction factor 1.5.

14 Claims, 15 Drawing Sheets

INK-JET RECORDING METHOD

BACKGROUND OF THE INVENTION

1. Field of the Invention

The present invention relates to a method of driving an ink-jet recording head used in an ink-jet recording apparatus in which recording is performed by firing ink droplets from an orifice of the ink-jet recording head toward a recording medium so that ink droplets are deposited on the surface of the recording medium, and also relates to an ink-jet recording method using this method of driving an ink-jet recording head. More particularly, the present invention relates to a method of driving an ink-jet recording head and an ink-jet recording method which can provide a high-density color image without having either significant smear (feathering) or mixture of colors (bleeding).

2. Related Background Art

Nowadays, water-based inks are most widely used in ink-jet recording apparatus since they have no problems associated with safety (toxicity) and smell. Water-based inks are commonly produced by dissolving or dispersing various water-soluble dyes or pigments into water or a liquid medium consisting of water and a water-soluble organic solvent. Furthermore, a humectant, dye dissolution promoter, mold inhibitor, or other agents are added to inks, as required, In the ink-jet recording technique, as many as a few thousand or more ink droplets can be ejected, and thus a high-speed recording operation can be easily achieved. Another advantage of the ink-jet recording apparatus is low noise during an operation. Furthermore, the ink-jet recording technique provides a high-resolution color image on usual plain paper. These various advantages have made the ink-jet recording apparatus very popular.

Recent advancement in the technology of personal computers has led to a great reduction in their cost and also a great improvement in their performance. Furthermore, the GUI environment has also become very popular and it is now available on a standard personal computer. As a result of such advancement, a need has arisen for recording apparatus, such as a printer, having higher performance in color reproduction, image quality, durability, resolution, and operation speed. Thus, the technology of recording an image is tend to make as great an amount of coloring material as possible remain on the surface of paper so as to obtain recording dots having a sharp edge without having feathering and bleeding.

There various known techniques to suppress the feathering and the bleeding. One of such techniques is disclosed in Japanese Patent Application Laid-Open No. 58-13675 (1983) in which polyvinyl pyrolidone is added to ink to control the absorption of ink dots into paper and expansion on the paper. In another technique disclosed in Japanese Patent Application Laid-Open No. 3-172362 (1991), a specific micro emulsion is added to ink to control the absorption of ink dots into paper and expansion on the paper.

In a third known technique disclosed for example in Japanese Patent Application Laid-Open No. 62-181372 (1987) and Japanese Patent Application Laid-Open No. 1-272623 (1989), sol-gel transition in ink is used. In this technique, ink which is in a gel state at room temperature and which changes to a sol state when heated is employed. Ink droplets in a sol state are deposited on recording paper, and then ink is cooled into a gel state thereby suppressing the penetration of ink into the recording paper.

In a fourth technique which has been disclosed recently in Japanese Patent Application Laid-Open No. 6-49399 (1994), a compound having the property of heat-induced reversible gelling is added to ink so as to achieve good color reproduction and good fixing process without having significant smear in a recorded image. The resultant image formed with this ink can be stored for a long time without degradation. The patent cited here also discloses a method of driving an apparatus to record an image using such an ink. This technique is based on the phenomenon in which when a solution of a certain water-soluble polymer is heated, the solubility in water decreases, and as a result, a white precipitate is produced in the solution (the temperature at which such a white precipitate is produced is referred to as a clouding point). Typical water-soluble polymers for use the above purpose include N-isopropyl acrylamide, polyvinyl methyl ether, polyethylene oxide, and hydroxypropylcellulose. The solubility of these polymers has a negative temperature coefficient, and these polymers are separated from a solution at temperatures higher their clouding points. In the precipitated state, hydrophobic microgel is generated, which causes a reduction in viscosity of the solution. If such an ink in the precipitated state is deposited on a recording medium, the temperature the ink drops down and thus its viscosity goes back to the original high value. The above increase in the viscosity of the ink suppress the penetration of the ink into the recording medium.

On the other hand, M. Croucher et al. have pointed out the disadvantages of the conventional uniform-composition ink and has proposed ununiform-composition ink in a latex form for use in an ink-jet recording apparatus (M. D. Croucher and M. L. Hair, "Design Criteria and Future Directions in Inkjet Technology", Ind. Eng. Chem. Res. 1989, 28, pp.1712–1718).

On the other hand, U.S. Pat. No. 4,246,154 discloses (1) ink containing particles of vinyl polymer colored by a dye wherein the particles are stabilized into anionic state. U.S. Pat. No. 4,680,332 discloses (2) an ununiform-composition ink obtained by dispersing a water-insoluble polymer, which includes an oil-soluble dye and which is bonded to a nonionic stabilizing agent, into a liquid medium. Furthermore, U.S. Pat. No. 5,100,471 discloses (3) a water-based ink composed of a solvent and coloring particles each consisting of a polymer core and a silica shell bonded to a dye. This type of ink has the advantage that very vivid colors can be obtained when deposited on paper. Furthermore, this type of ink is stable at high temperatures and has high resistance to water.

In a sixth technique disclosed in Japanese Patent Application Laid-Open No. 3-240586 (1991), a non-aqueous ink consists of coloring particles dispersed into kerosene or the like wherein each coloring particle is covered with a resin which swells in the dispersing medium. This ink is said to be good in that feathering does not occur in a printed image and that nozzles via which ink is ejected are not blocked by ink.

However, in the first and second techniques described above, although penetration of ink into paper can be suppressed, ink remains on the paper for a rather long time and thus a long time is required for the ink deposited on the paper to be fixed. Another problem of these technique is bleeding.

In the case of the sol-gel transition ink according to the third technique, the ink should be stored in a proper temperature range, otherwise the ink can become soft and can flow, which will cause bleeding and smear in a printed image.

In the ink containing a compound which gels in a reversible fashion when heated according to the fourth technique, since water-soluble cellulose ether or the like is used, the viscosity of the ink increases slowly when the ink is cooled. Therefore, this type of ink is not suitable for use in a high-speed recording operation which is generally essential in an ink-jet recording apparatus in which one pixel is usually recorded in a few ten or msec. or in a shorter time. Furthermore, the ink for use in the ink-jet recording apparatus should have a low viscosity less than 20 mPa·sec. when ink is ejected. This means that it is difficult to achieve a sufficient amount of increase in the viscosity. Therefore, the increase in the viscosity.

Of three of the fifth techniques, the technique (1) in which the ink is stabilized with anions has the disadvantage that stable dispersion is possible only in a narrow pH range. Furthermore, dyes which can be employed in this technique are limited. Another problems is that ink dots deposited on paper do not expand to a sufficient extent and thus it is difficult to obtain a high enough optical density. For use in a high-speed recording operation, it is required to fix deposited dots in a short time. However, in this type of ink, as in other conventional inks, fixing of the ink occurs essentially only by evaporation and penetration and thus it is difficult to reduce the fixing time to a sufficiently low level.

On the other hand, in the case of the ink includes a dispersed water-insoluble polymer bonded to a nonionic stabilizing agent according to the technique (2), although a wider variety of dyes can be employed, fixing mechanism is also based on the evaporation and penetration of ink, and therefore it is difficult to reduce the fixing time to a sufficiently low level. Furthermore, the long fixing time can cause bleeding.

On the other hand, although the dispersion ink having the polymer core/silica shell structure according to the technique (3) is excellent in that the dye is dispersed in a stable fashion, this type of ink does not have any special means for aggregating a coloring material when the ink is deposited on paper. As a result, the ink cannot provide a high enough optical density. Furthermore, the ink deposited on paper is fixed only by evaporation and penetration, the fixing time is rather long and bleeding occurs.

The problem common for all three techniques described above is that adhesion of coloring particles to the surface of paper is not taken into consideration and thus the recorded image is poor in resistance to rubbing.

In the sixth technique, since kerosene is used as the dispersion medium, the ink has problems of smell and toxicity.

Now, transfer of ink onto paper will be discussed. It is known that the process of transferring liquid onto paper can be represented by Lucas-Washburn's formula. When the liquid is water, the Lucas-Washburn's formula becomes as follows:

$$V = V_r + K_a\sqrt{T - T_W} \tag{1}$$

where V denotes the amount of liquid transferred onto paper, $V_r$ the constant representing the roughness of paper, $K_a$ the absorption coefficient, T the transfer time, and $T_w$ the wetting start time. In the above formula, the $K_a$ depends on the properties of paper and ink and can be represented as follows:

$$K_a = \sqrt{\frac{r\gamma\cos\theta}{2\eta}} \tag{2}$$

where r denotes the radius of capillaries, γ the surface tension of the liquid, θ the angle of contact between the liquid and paper, and η the viscosity of the liquid.

It can be seen from formula (1) that in order for the coloring material to remain on the surface of paper, it is required that the penetration of the liquid should be as slow as possible, that is, Ka should be as small as possible (so that evaporation can occur during the slow penetration process). To obtain a small value of $K_a$, it required that the ink should be small enough in surface tension and should be large enough in the viscosity and the angle of contact. However, for use in the ink-jet recording operation, the ink should have particular properties, and this requirement makes it difficult to adjust $K_a$ to a desired value.

On the other hand, in the case where the liquid is a non-aqueous solvent such as ethanol or the like, the wetting time $T_w$ is small enough to be neglected in formula (1). This results in a reduction in the fixing time. However, $K_a$ becomes great, and quick penetration occurs. As a result, a recorded image will have a great amount of feathering. In formula (2), the term cosθ depends on the combination of ink and paper. In other words, although a certain kind of paper may result in a desirable value of cosθ, another kind of paper may result in an undesirable value of cosθ. Thus the cosθ is sensitive to the kind of recording paper used. This is undesirable in applications of ink-jet recording apparatus.

The problems describes above can also occur in conventional inks of the coloring-material dispersion type as long as the mechanism of fixing a recorded image is based only on the penetration and evaporation of ink.

SUMMARY OF THE INVENTION

In view of the above, it is an object of the present invention to provide a method of driving an ink-jet recording head in which fixing of ink deposited on paper occurs not only by the evaporation and penetration of the ink but also by other mechanisms thereby ensuring that a high optical density can be obtained without having significant feathering and bleeding. It is another object of the present invention to provide an ink-jet recording method based on the above method of driving an ink-jet recording head.

The above objects can be achieved by the present invention as described below. That is, the present invention provides an ink-jet recording method, comprising actuating a heating element in a recording head in response to a recording signal, said heating element being in contact with an ink, to heat the ink thereby creating bubbles in the ink and thus ejecting ink droplets from the head so that recording is effected with the ink droplets, wherein said ink is a liquid having a property such that its viscosity changes abruptly when heated and said heating element generates heat so that the average heat flux $q_o$ from the surface of the heating element to the ink satisfies the condition represented by the following formula (3):

$$q_o \le \frac{\alpha\kappa\pi S(T_B - T_o)^2}{4V(T_P - T_o)} \tag{3}$$

where κ denotes the coefficient of thermal conductivity of the ink, S the effective area of the heating element, V the volume of ink droplets ejected by one driving operation, $T_B$ the temperature of the ink at which bubbles are created in the ink, $T_o$ the temperature of the ink before the ink is ejected, $T_P$ the transition temperature of the ink at which the abrupt change in the viscosity occurs, and a the correction factor 1.5.

DESCRIPTION OF THE PREFERRED EMBODIMENTS

Figure 1:
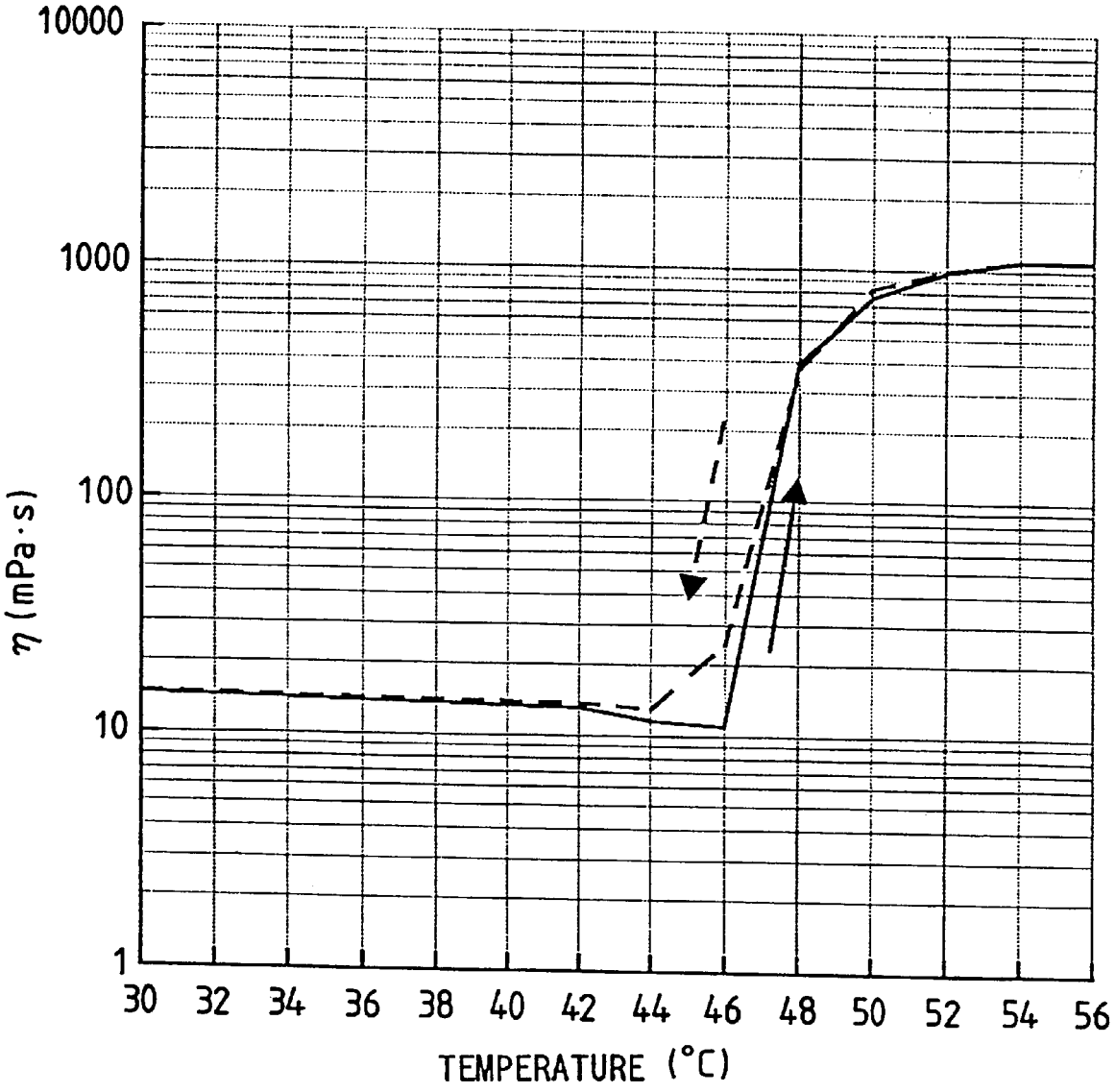
FIG. 1 is a graph illustrating the dependence of the viscosity of an aqueous solution of a polymer on temperature.

The inventors of the present invention have concluded that the problems described above are due to the fact that ink is always in a state of an uniform solution of a coloring material and a solvent regardless of the temperature. The above conclusion has led the inventors of the present invention to the idea that the state of ink should be changed in response to the change in temperature so that when the ink is deposited on a recording medium, a coloring material and a solvent are separated from each other. Furthermore, they have obtain the idea of effectively ejecting the ink of such the type toward a recording medium.

The improvement in the quality of a recorded image achieved by the present invention will be described in detail below in relation mainly to the change in the state of a heat-reversibly viscosity-increasing polymer included in ink. The term "heat-reversibly viscosity-increasing polymer" is used here to represent a polymer which exhibits heat-reversible phase separation from an aqueous solution at temperatures higher than the transition temperature. The "state transition of the heat-reversibly viscosity-increasing polymer" refers to the transition at a specific temperature (transition temperature) from a state in which the polymer are resolved in ink in a dissociated fashion at room temperature to a state in which polymer are associated with each other to form a liquid which a high concentration and high viscosity in which the coloring material molecules are bonded to the polymer. If the ink in the above-described high-viscosity state is deposited on a recording medium, then a thick coloring-material phase remains on the recording medium while a thin solvent phase penetrates into the recording medium. This makes it possible to record a high-quality image with excellent color reproduction and with sharp edges without introducing bleeding. Thus, high stability can be obtained in the recording operation as well as in the resultant image. In order for the ink to be used in a wide range of environmental temperatures, it is required that the state transition described above should be reversible.

However, in practical applications in which high reliability is not needed over a wide temperature range, as in the case where the temperature inside the apparatus in which the ink is used never exceeds the temperature at which such the state transition occurs in the polymer, it is not necessarily required that the state transition of the polymer should be reversible. That is, what is essential in the present invention is that at a temperature higher than a specific value the polymer goes to a state in which it has an increased viscosity or it gels. Thus, the present invention does not necessarily require the state transition of the polymer should be reversible. For example, Japanese Patent Application Laid-Open No. 63-23981 (1988) discloses an ink containing ovalbumin which alters at 72° C. into an elastic gel state. The method of driving an ink-jet recording head according to the present invention is also effective for the ink of such the type. In the following description, although an ink containing a heat-reversibly viscosity-increasing polymer is described by way of an example, it should be understood that the present invention is not limited to such the polymer. Other types inks including different substances, which can be used in different temperature ranges, may also be employed.

In a practical operation of ejecting ink droplets using an ink-jet recording head, an ink with a low viscosity is more desirable to achieve a high-speed recording operation. Taking this into consideration, one possible way of achieving the state transition described above is to eject droplets of ink in the low-viscosity state from a recording head toward a recording medium heated up to a temperature higher than the transition temperature so that the ink droplets which have arrived at the surface of the recording medium are subjected to the state transition.

In this case, the temperature of ink droplets is lower than the temperature of the recording medium, and the surface of the recording medium is cooled by ink droplets when the ink droplets have arrived at the surface of the recording medium. Thus, after a small time delay, the temperature of ink droplets reaches the transition temperature. During the time period until the temperature of ink droplets reaches the transition temperature, the ink remains in a low-viscosity state, and therefore the ink can penetrate into the recording medium according to Lucas-Washburn's formula. This means that the above technique can solve the problem of the poor resistance of an recorded image to rubbing that can occur when the ink droplets are heated to the transition temperature before they leave the recording head so that the entire coloring material remains on the surface of the recording medium. However, a disadvantage of this technique is that an additional device for heating a recording medium is required. Such the device will have a large heat capacity and have a large heat-radiating area. As a result, the device will have a very poor heat efficiency in heating a recording medium.

In addition to the time delay in the increase in temperature, another period of time is required for the ink to alter into a high-viscosity state after the temperature of the ink has reached the transition temperature. This is because even if the ink is heated instantly to a temperature higher than the transition temperature from room temperature, polymer molecules can not associate instantly, and a certain time is required for them to associate. In other words, even if thermal energy is applied to ink droplets before they are ejected so that their average temperature becomes instantly higher than the transition temperature, the viscosity and other properties do not change instantly. This means that it is possible to heat ink droplets to a temperature higher than the transition temperature before ejecting them without having any significant problems associated with the ejection characteristics. Thus, this technique can provide similar effects to those obtained by the previous technique in which a recording medium is preheated.

The transition temperature at which state transition occurs in ink is preferably set to a value which is higher than the environmental temperature (room temperature) at which a recording apparatus is usually used and which can provide a sufficient increase in the viscosity of the ink, and more specifically in the range from 35 to 100° C. (there should be a sufficiently large difference between temperatures before and after the transition). However, if the transition temperature is set to a temperature higher than 100° C., water contained in ink evaporates and the increase in the viscosity becomes too great. Therefore, it is desirable that the transition temperature be lower than 100° C.

The present invention will be described in greater detail below with reference to preferred embodiments. In these embodiments according to the present invention, it is possible to employ any ink as long as it contains an aqueous solution or an aqueous suspension of a heat-reversibly viscosity-increasing polymer the viscosity of which increases when heated to a temperature higher than a specific temperature (transition temperature) wherein the above change in the viscosity occurs in a reversible fashion. Specific examples of such heat-reversibly viscosity-increasing polymers include: water-soluble vinyl polymers (A) containing 50% or more by weight of a constituent of a vinyl-based carboxylate (a) of an addition compound of alkylene oxide to an active hydrogen compound with a ring containing nitrogen, or similar polymers in which the above-described vinyl-based carboxylate (a) is a (meta) acryl ester of an addition compound of 1–20 mol ethylene oxide and/or propylene oxide to (substitution) morpholine.

The above-described active hydrogen compounds with a ring containing nitrogen refer to compounds containing active hydrogen to which a ring containing nitrogen and alkylene oxide are to be joined to form an addition compound. Specific examples of alicyclic compounds containing nitrogen include: compounds having an aziridine ring such as aziridine, and 2-methyl aziridine; compounds having a pyrrolidine ring such as pyrrolidine, 2-methyl pyrrolidine, 2-pyrolidone, and succinimide; compounds having a piperidine ring such as piperidine, 2-methyl piperidine, 3,5-dimethyl piperidine, 2-ethyl piperidine, 4-piperidino piperidine, 4-pyrrolidino piperidine, and ethyl pipecolinate; compounds having a piperazine ring such as 1-methyl piperazine, and 1-methyl-3-ethyl piperazine; compounds having a morpholine ring such as morpholine, 2-methyl morpholine, and 3,5-dimethyl morpholine; and ϵ-caprolactam. Specific examples of unsaturated cyclic compounds containing nitrogen include: 3-pyrroline, 2,5-dimethyl-3-pyrroline, 2-hydroxypyridine, 4-pyridylcarbinol, and 2-hydroxypyrimidine. Of these compounds, the alicyclic compounds containing nitrogen are preferable for the present purpose. Of such alicyclic compounds, the compounds having a piperidine ring and the compounds having a morpholine ring are more preferable. Of these two classes of compounds, the compounds having a morpholine ring are most preferable. Specific examples of the alkylene oxides include ethylene oxide, propylene oxide, and butylene oxide.

In the present invention, the transition temperatures of the heat-reversibly viscosity-increasing polymers described above can be easily adjusted by properly selecting the kind of alkylene oxide and adjusting its amount (in moles) of addition. For example, when ethylene oxide is employed, the transition temperature increases with the amount (in moles) of the added ethylene oxide. In contrast, when propylene oxide or butylene oxide is employed, the transition temperature decreases with the amount (in moles) of the added propylene oxide or butylene oxide. The preferable amount of added alkylene oxide is in the range of 1 to 20 moles, and more preferably, in the range from 1 to 5 moles.

In the present invention, the vinyl-based carboxylates (a) used as a constituent of the water-soluble vinyl polymers (A) refer to esters formed from the above-described addition compouds of alkylene oxides and vinyl-based carboxylic acids. Specific examples of vinyl-based carboxylic acids which can be preferably used in the present invention include acrylic acid, methacrylic acid (hereafter these two acids will be referred to as (meta) acrylic acids), maleic acid, vinyl benzoate, and derivatives of these acids. Of these, (meta) acrylic acids and derivatives of (meta) acrylic acids are more preferable.

The water-soluble vinyl polymers (A) containing vinyl-based carboxylates (a) are polymers containing one or more kinds of the above-described vinyl-based carboxylates (a) or copolymers of one or more kinds of the above-described vinyl-based carboxylates (a) and other vinyl monomers (b), wherein the content of the one or more kinds of the vinyl-based carboxylates (a) contained as constituents in the water-soluble vinyl polymers (A) should be greater than 50% by weight.

Specific examples of the vinyl monomers (b) described above include hydroxyethyl (meta) acrylate, polyethylene glycol mono (meta) acrylate, (meta) acrylamide, N-hydroxymethyl (meta) acrylamide, N-vinyl-2-pyrolidone, (meta) acrylic acid, (anhydrous) maleic acid, styrene sulfonic acid, N,N-dimethylaminoethyl (meta) acrylate, N,N-diethylaminopropyl (meta) acrylate, methyl (meta) acrylate, butyl (meta) acrylate, glycidyl (meta) acrylate, N-butyl (meta) acrylamide, N-cyclohexyl (meta) acrylamide, (meta) acrylonitrile, styrene, vinyl acetate, vinyl chloride, butadiene, and isoprene.

Of the monomers constituting the vinyl-based polymers (A), the content of the vinyl-based carboxylates (a) affects the viscosity-transition temperature range in which an abrupt increase occurs in the viscosity. To achieve as narrow a viscosity-transition temperature range as possible, the content of the vinyl-based carboxylate(s) (a) is preferably greater than 50%, or more preferably greater than 70%, of the total weight of the vinyl-based polymer (A).

In aqueous solutions of the heat-reversibly viscosity-increasing polymers described above, although their viscosity decreases with the increasing temperature in the range lower than the specific transition temperatures, an abrupt increase in the viscosity occurs when the temperature exceeds the transition temperatures. A distinctive feature of the above-described aqueous solutions is that substantially no hysteresis is observed in the viscosity-temperature characteristic. To achieve a sufficient viscosity when ink is deposited on a recording paper, the composition of the ink is adjusted so that the viscosity increases at a rate greater than 40 mPa·sec/°C. in the temperature range higher than the transition temperature when the aqueous solution containing 5% by weight of the heat-reversibly viscosity-increasing polymers described above is heated at a rate of 1° C./min. The characteristic in terms of the increase in the temperature varies depending on the type of the recording head employed. However, as described earlier, the transition temperature can be easily adjusted to a desired value by properly selecting the kind of the alkylene oxide contained in the vinyl-based carboxylate (a) constituting the heat-reversibly viscosity-increasing polymer and/or by adjusting its amount (in moles) of addition. Therefore, the transition temperature can be optimized for a wide variety of recording heads. However, since the transition temperature is also affected by the types and the amounts of additional constituents contained in the ink, such as a salt, surface-active agent, and solvent, it is required to control the overall composition of the ink.

FIG. 1 is a graph illustrating an example of the dependence of the viscosity on temperature for an aqueous solution containing 5 wt % heat-reversibly viscosity-increasing polymer. In this specific example, the heat-reversibly viscosity-increasing polymer is obtained as follows. First, 100 parts by weight of 2-(2-morpholino ethoxy)ethyl methacrylate (ether obtained from methacrylic acid and an addition compound of morpholine with 2-mol ethylene oxide) and 0.1 parts by weight of 2,2'-azobis (2,4-dimethyl valeronitrile) are placed in an ampoule. After cryodeaerating them, the ampoule is sealed. Then, the ampoule is heated at 60° C. for 8 hours so that polymerization occurs. In FIG. 1, the solid line represents the change in the viscosity which occurs when the aqueous solution is heated at a rate of 1° C./min, while the broken line is for the case where the aqueous solution is cooled at a rate of 1° C./min. As can be seen from FIG. 1, this specific aqueous solution has a transition temperature of 46° C.

In the present embodiment of the invention, the molecular weight of the heat-reversibly viscosity-increasing polymer and its amount contained in the aqueous solution should be selected so that the viscosity of the ink-jet ink should be in the allowable range (1 to 20 mPa·sec) at room temperature. The weight-average molecular weight of the heat-reversibly viscosity-increasing polymer is preferably in the range from 10,000 to 1,000,000. If the molecular wight is greater than 1,000,000, then the molecular chain becomes too long, which results in a reduction in the re-dissolving rate and creation of tails. In the case where the molecular weight is close to 10,000 in the above allowable range, the degree of the increase in the viscosity is low, and therefore it is required that the ink contains a greater amount of heat-reversibly viscosity-increasing polymer. More specifically, in this case, it is preferable that the content of the heat-reversibly viscosity-increasing polymer be in the range from 2 to 10% by weight. On the other hand, the heat-reversibly viscosity-increasing polymer has a large molecular weight close to 1,000,000 within the allowable range, a small amount of material is sufficient to achieve the required increase in viscosity. More specifically, in this case, it is preferable that the content be in the range from 0.005 to 3% by weight.

In the present invention, a mixture of various heat-reversibly viscosity-increasing polymers having different molecular weights may also be employed.

In the present invention, the ink containing the above-described heat-reversibly viscosity-increasing polymer can be used to achieve a good recording operation. However, it is more desirable that the ink also contain hydrophobic particles in dispersion form to achieve an increase in viscosity at temperatures higher than the transition temperature in a more effective fashion. At temperatures higher than the transition temperature, the heat-reversibly viscosity-increasing polymer loses its hydrophilicity and becomes hydrophobic. In this state, if there are also hydrophobic (polymer) particles in dispersion form such as acrylic emulsion, then the affinity between the heat-reversibly viscosity-increasing polymer and the hydrophobic particles in dispersion form becomes greater than that between the heat-reversibly viscosity-increasing polymer and water, and, as a result, the heat-reversibly viscosity-increasing polymers are combined with the hydrophobic particles, which results in an increase in the viscosity. The experiments performed by the inventors of the present invention have shown that the increase in the viscosity in the range from 10 to 50% can be obtained by the coexistence with the dispersion of particles wherein the degree of the increase depends on the type and the amount of the dispersion of particles added.

Specific examples of dispersion of hydrophobic particles include acrylic emulsions, styrene-acryl emulsions, styrene-divinylbenzene emulsions urethane emulsions, and silicone-acryl emulsions. The hydrophobic polymer emulsions preferably-contain particles with a diameter in the range from 10 to 80 nm and also contain a 8 to 40 wt % solid constituent. In a preferable form, the ink contains a 0.1 to 10 wt % emulsion with a pH value in the range from 6.0 to 8.5. It is desirable that the polymer used in the above emulsion have good heat resistance and have a high degree of hardness. Furthermore, polymers having a high degree of crosslinking are more suitable for use in the ink-jet printing operation. In particular, for the ink-jet printing method in which thermal energy is applied to ink, it is desirable that the maximum allowable temperature of the polymer be higher than the critical temperature of water which is a main solvent medium of the ink. More specifically, it is desirable that the 10%-weight-loss temperature Tb of the polymer be greater than 300° C. Of the various emulsions described above, styrene-divinylbenzene emulsions (Tb=380° C.) have a highest degree of crosslinking and thus they are most preferable.

Now coloring materials contained in the ink used in the present invention will be described below.

Coloring materials of a first type which can be used in the invention are dyes. Various dyes can be employed as long as the dyes react with the heat-reversibly viscosity-increasing polymer molecules and association process of polymer chains is enhanced at temperatures higher than the transition temperature. Such dyes include direct dyes, acid dyes, food dyes, basic dyes, and reactive dyes. These dyes have a hydrophobic coloring skeleton occupying a greater part of each dye, a few solubilization groups such as sulfonates (—$SO_3M$), carboxylates (—COOM), and ammonium salts ($NH_4X$), and a hydrogen-bonding group such as a hydroxyl group (—OH), amino group (—$NH_2$), and imino group (—NH—), and can form a complex with the heat-reversibly viscosity-increasing polymer of the invention.

Disperse dyes may also be employed in the present invention. However, themselves are insoluble in water. Therefore, it is required that a polycyclic anionic surface-active agent such as naphthalenesulfonate serving as a dispersing agent be also added to the ink so that the dyes behave like anionic substances.

Specific examples of dyes include: black dyes such as C. I. Direct Black 17, C. I. Direct Black 19, C. I. Direct Black 62, C. I. Direct Black 154, IJA 260, IJA 286, C. I. Food Black 2, C. I. Reactive Black 5, C. I. Acid Black 52, and C. I. Projet Fast Black 2; yellow dyes such as C. I. Direct Yellow 11, C. I. Direct Yellow 44, C. I. Direct Yellow 86, C. I. Direct Yellow 142, C. I. Direct Yellow 330, C. I. Acid Yellow 3, C. I. Acid Yellow 38, C. I. Basic Yellow 11, C. I. Basic Yelow 51, C. I. Disperse Yellow 3, C. I. Disperse Yellow 5, and C. I. Reactive Yellow 2; magenta dyes such as C. I. Direct Red 227, C. I. Direct Red 23, C. I. Acid Red 18, C. I. Acid Red 52, C. I. Basic Red 14, C. I. Basic Red 39, C. I. Disperse Red 60, and IJR-016; and cyan dyes such as C. I. Direct Blue 15, C. I. Direct Blue 199, C. I. Direct Blue 168, C. I. Acid Blue 9, C. I. Acid Blue 40, C. I. Basic Blue 41, C. I. Acid Blue 74, and C. I. Reactive Blue 15. In addition to the above dyes, it is also possible employ other dyes such as those which are enhanced in resistance to water by reducing the amount of the solubilization group, and special dyes whose solubility is adapted to be sensitive to the change in pH. The concentration of the dye in ink can be set to a desired value within the range allowed by its solubility. In general, however, it is desirable that the concentration of the dye be in the range from 1 to 8% by weight. In the case where the ink is used for recording on cloths or metal (such as alumite), it is desirable that the dye concentration be in the range from 3 to 10% by weight. On the other hand, when the ink is used to form an image with multi gray levels, it is desirable that the dye concentration be in the range from 0.1 to 10% by weight.

Coloring materials of a second type are carbon black and organic pigments. Also in the case of the coloring materials of this type, as in the disperse dyes described above, a dispersing agent is added to the ink so that the coloring materials can interact with the polymer of the invention via the dispersing agent. Various carbon black and organic pigments can be employed in the present invention. In particular, the carbon black produced by the furnace method or the channel method can be preferably used in black inks. In this case, it is desirable that the primary particle diameter be in the range from 10 to 40 $\mu$m, the BET relative surface area be in the range from 50 to 300 $m^2/g$, and the DBP oil absorption be in the range from 40 to 150 ml/100 g. Specific examples of such carbon blacks include: common carbon blacks (such as those supplied by Mitsubishi-Kagaku Co., as product numbers 2300, 900, MCF88, No.33, No.40, No.45, No.52, MA7, MA8, #2200B; Raven-1255 and Raven-1060 available from Columbia Carbon Co.; Regal-330R, Regal-660R, and Mogul L available from Cabot Co.; Color Black FW18, Printex 35, and Printex U available from DEGUSSA Co.); carbon blacks whose surfaces are subjected to oxidization or plasma treatment; and organic pigments such as insoluble azo pigments, soluble azo pigments, phthalocyanine pigments, isoindolynon high-quality pigments, quinacridone high-quality pigments, dioxane violets, and perinone/perylene high-quality pigments. Furthermore, color lake obtained by dying a loading pigment with a dye may also be employed in the present invention. This coloring material can also be classified into the above second group of color materials.

A third group of coloring materials are coloring particles whose surface is bonded to dye so as to make the dye insoluble in water. More particularly, the "coloring particles" refer to organic particles each having a core/shell structure wherein the surface of the shell contains a reactive group chemically bonded to dye. The reactive group may be selected from carboxyl group, hydroxyl group amino group, epoxide group, amide group, hydroxy methyl group, and isocyanato group.

The core of the organic particles with core/shell structure consists of polymers of styrene-divinylbenzene with a high degree of crosslinking. Furthermore, the core is covered with a shell containing the above-described reactive group. In order for the shell to be combined with a sufficient amount of dye, the thickness of the shell is preferably about 30% of the particle diameter. A specific example of the organic particles with core/shell structure is the particle dispersion S2467 available from Nippon Gosei-gomu Co. More particularly, it is desirable that the particles diameter of S2467 be in the range from 10 nm to 80 nm and that it contains a 10 wt % solid constituent. If the shell on the surface of each organic particle is denaturazation with an amino group, the resultant particles can form ionic bonds with anionic dye ions as in the case of direct dyes. This makes it possible for the particles to be colored by dyes. On the other hand, if the shell on the surface of each organic particle is denaturazation with an carboxyl group the resultant particles can form ionic bonds with cationic dye ions such as basic dyes. Thus, it becomes possible to color the shell with dyes. The coloring particles colored with dye can be employed in the present invention in a similar manner to the organic pigments described above. Furthermore, hydrophobic particles in dispersion form may also be added to ink so as to enhance the viscosity transition property.

The coloring materials of the above three types may be used in various ways. Either only one of these color materials may be used or various color materials may be mixed. For example, coloring particles and other dye may be mixed together, or coloring particles may be mixed with carbon black or organic dyes so as to improve resistance to water thereby improving the reliability or durability of an recorded image compared to the case where only a dye is used. Furthermore, the mixing of color materials can also provide a greater increase in the viscosity, which results in reproduction of more vivid colors, and which also results in better sharpness at edges of recorded dots. Thus, the mixing can provide various improvements in the recorded image.

As for the liquid medium for dissolving or dispersing the above-described constituents of the ink used in the present invention, water or a mixture of water and a water-soluble organic solvent may be employed. Specific examples of water-soluble organic solvents which are preferable for use in the ink of the present invention include: amides such as dimethylformamide, and dimethylacetamide; ketones such as acetone; ethers such as tetrahydrofuran and dioxane; polyalkylene glycols such as polyethylene glycol and polypropylene glycol; alkylene glycols with an alkylene group containing 2 to 6 carbon atoms such as ethylene glycol, propylene glycol, butylene glycol, triethylene glycol, 1,2,6-hexanetriol, thioglycolic acid, hexylene glycol, diethylene glycol; glycerin; lower alkyl ether of polyhydric alcohols such as ethylene glycol monomethyl (or ethyl) ether, diethylene glycol monomethyl (or ethyl) ether, triethylene glycol monomethyl (or ethyl) ether; cyclic amide compounds such as N-methyl-2-pyrolidone, 1,3-dimethyl-2-imidazolidine, triethanolamine, sulfolane, dimethyl sulfoxide, 2-pyrolidone, ϵ-caprolactam; and imide compounds such as succinimide.

To improve the reliability and stability of the ink in operation and also during storage thereby making the ink more suitable for use in the ink-jet recording operation, a humectant or a dissolution promoting agent may also be added to the ink. Specific examples of such materials include: alkylene glycols such as 1,2-ethanediol, 1,2-propanediol, 1,3-propanediol, 1,2-butanediol, 1,3-butanediol, 1,4-butanediol, 2,3-butanediol, 1,5-pentanediol, 1,7-heptanediol, 2-methyl-2,4-pentanediol, 2-ethyl-1,3-hexanediol, glycerin, diethylene glycol, triethylene glycol, tetraethylene glycol, polyethylene glycol 200, dipropylene glycol, 2,2'-thiodiethanol, and 1,2,6-hexanetriol; alcohol amines such as monoethanolamine, diethanolamine, triethanolamine; aprotic polar solvents such as dimethylformamide, dimethylacetamide, dimethyl sulfoxide, sulfolane, 1,3-propanesultone; lower alkyl ether of polyhydric alcohols such as 1,2-dimethoxyethane, 1,2-diethoxyethane, 1,2-dibutoxyethane, diethylene glycol dimethyl ether, diethylene glycol diethyl ether, diethylene glycol dibutyl ether, 2-methoxyethanol, 2-ethoxyethanol, 2-(methoxymethoxy)ethanol, 2-butoxyethanol, diethylene glycol monomethyl ether, diethylene glycol monoethyl ether, diethylene glycol monobutyl ether, triethylene glycol monomethyl ether, triethylene glycol monoethyl ether, 1-methoxy-2-propanol, 1-ethoxy-2-propanol, dipropylene glycol, dipropylene glycol monomethyl ether, dipropylene glycol monoethyl ether, tripropylene glycol methyl ether; formamide; 2-pyrolidone; N-methyl-2-pyrolidone; 1,3-dimethyl imidazolidine; sorbitol; urea, and 1,3-bis(β-hydroxyethyl)urea.

It is preferable that the content of these addition agents be in the range from 1 to 30% of the total weight of the ink.

Furthermore, alkyl alcohol such as methanol, ethanol, propanol, 2-propanol, 1-butanol, or 2-butanol may also be added to the ink so as to make it easier for the ink to be ejected during the ink-jet recording operation. The content of the alcohol for that purpose is preferable in the range from 1 to 10% by weight.

In the present invention, other addition agents such as surface-active agent, pH adjustor, corrosion protection agent, mold inhibitor, and anti-oxidant may also be added to the ink as required.

The technique for ejecting ink having the above composition will be descried below.

In the present invention, when bubbles are created in ink so as to apply kinetic energy to ink droplets thereby ejecting them, the average temperature of the ejected ink droplets is raised to a value higher than the transition temperature described early. This technique is more effective than the technique in which paper is preheated. However, the conventional heating techniques cannot apply sufficient thermal energy to ink.

Thus, in the present invention, the ink-jet recording head is driven in a different way as described below.

When a constant heat flux is generated from a boundary into a medium which can be regarded as having a substantially infinite volume, the heat conduction can be represented by the following formula (4) on the basis of an one-dimensional model.

$$T = \frac{2q_o}{\kappa}\sqrt{\frac{\alpha t}{\pi}}\exp\left(\frac{-x^2}{4\alpha t}\right) - \frac{q_o}{\kappa}x\left(1 - \mathrm{erf}\frac{x}{2\sqrt{\alpha T}}\right) + T_o \tag{4}$$

where x denotes a position coordinate relative to the surface of the heating element (measured along a direction perpendicular to the surface of the heating element), t the time which has elapsed after the generation of the heat flux was started, T the temperature of the ink at that time and at that position coordinate, $T_0$ the temperature that the ink was held at before the heating was started, $q_0$ the average heat flux from the surface of the heating element into the ink, κ the coefficient of thermal conductivity, and α is a constant equal to κ/ρc wherein ρ is the density of the ink and c is the specific heat of the ink. In the above formula, erf is Gauss' error function which is defined as:

$$\mathrm{erf}\frac{x}{2\sqrt{\alpha t}} = \frac{2}{\sqrt{\pi}}\int_o^{\frac{x}{2\sqrt{\alpha t}}} e^{-\eta^2}\,d\eta \tag{5}$$

Figure 8:
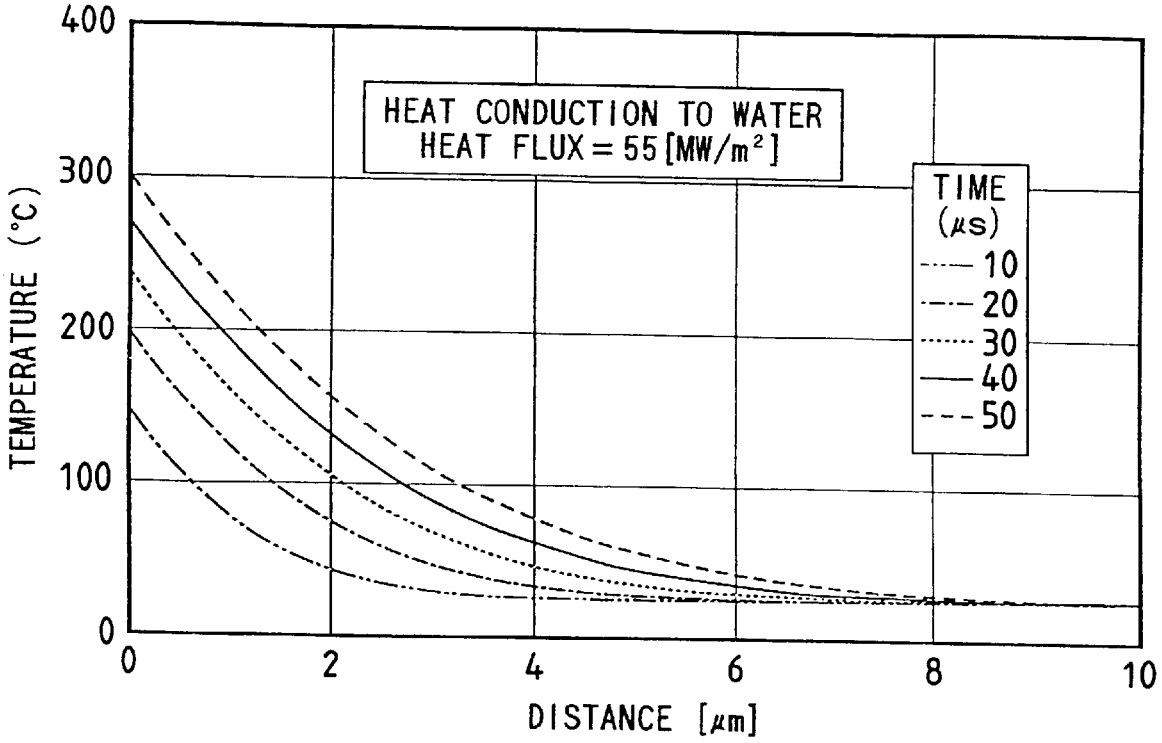
FIG. 8 illustrates the conduction of heat from the surface of a heating element into water.

FIG. 8 illustrates the conduction of heat from the surface of the heating element into water having an initial temperature of 25° C. wherein the water can be regarded as extending to a virtually infinite distance (semi-infinite distance). In FIG. 8, the temperature distributions measured at 10 μsec. time intervals are shown. The temperature distributions are calculated with the assumption that a constant heat flux of 55 $MW/m^2$ is generated from the surface of the heating element. It can be seen from FIG. 8 that in a time period of 50 μsec. almost all thermal energy remains within the 10 μm region from the surface of the heating element.

The thermal conduction based on the one-dimensional model will be discussed in further detail below. In practice, the heating element and ink extend in three-dimensional space. In a strict sense, therefore, the conduction heat should be discussed on the basis of the three-dimensional model. However, as can be seen from FIG. 8, within the time period of a few ten μsec, the heat conduction occurs substantially only within a very limited region which is small enough compared to the size of the heating element. This means that the one-dimensional model is a good approximation of the actual heat conduction.

Formula (4) represents the heat conduction into the ink as a function of time after the heating is started. The flow of heat in the region near the surface of the heating element can be determined as follows. In formula (4), if X is 0, then the following formula can be obtained:

$$T_{(t)} = T_o + \frac{2q_o}{\kappa}\sqrt{\frac{\alpha t}{\pi}} \tag{6}$$

The amount of heat $Q_{give}$ which has been given by the heating element to the ink during the period of time until t can be estimated as follows:

$$Q_{give} = Sq_0 t \tag{7}$$

where S is the effective area of the heating element. In the present invention, it is essential that the average temperature of ink droplets ejected from a nozzle by means of bubbles created by the heating be higher than the transition temperature described above. Therefore, the minimum amount of heat $Q_{get}$ that the ink should get is given as:

$$Q_{get} = \rho cV(T_P - T_0) \tag{8}$$

where V denotes the volume of an ejected ink droplet. $Q_{give}$ must be equal to $Q_{get}$, and thus the minimum heating time $t_{give}$ required can be given by formula (9) for the case where the average heat flux is $q_0$.

$$t_{give} = \rho cV(T_P - T_0)/Sq_0 \tag{9}$$

where $T_P$ denotes the transition temperature in the case of polymers, $T_P$ represents the average transition temperature).

If a water vapor bubble is created-before the time $t_{give}$, then the surface of the heating element becomes covered by the bubble and it becomes impossible to transfer a sufficient amount of thermal energy to the ink required to induce a state transition in the ink. Therefore, it is required that the temperature of ink present near the surface of the heating element should not reach the bubbling start temperature $T_B$ before the time $t_{give}$. Thus, it is essentially required that the following formula (10) should hold:

$$T_{(t)} \leq T_B \tag{10}$$

From the above formulas, the following formula can be obtained:

$$q_o \leq \frac{\kappa\pi S(T_B - T_o)^2}{4V(T_P - T_o)} \tag{11}$$

In theory, in the method of driving the ink-jet recording head according to the present invention, the heating element should be driven so that at least formula (11) is satisfied.

In the above discussion, the bubbling start temperature $T_B$ does not refer to the boiling point of water at a pressure of 1 atm. When water is heated very quickly, superheating occurs and boiling does not occur immediately until the temperature of water reaches the critical temperature. In practice, for various reasons, bubbling can occur before the temperature reaches the critical temperature.

Further detailed discussion can be found for example in "Boiling Phenomena", Stralen and Cole, McGraw-Hill, 1979, and also in the paper presented by Iida et al. in the 27th Symposium on Heat Conduction (May, 1990).

The ink-jet recording method comprising actuating a heating element in a head according to the present invention is used for a method comprising applying thermal energy to ink so as to create bubbles in the ink thereby ejecting ink droplets.

Figure 2:
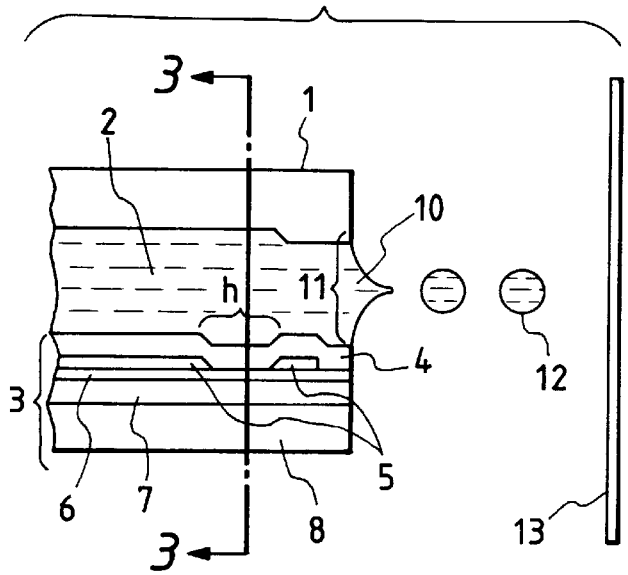
FIG. 2 is a longitudinal sectional view of a head of an ink-jet recording apparatus.
Figure 3:
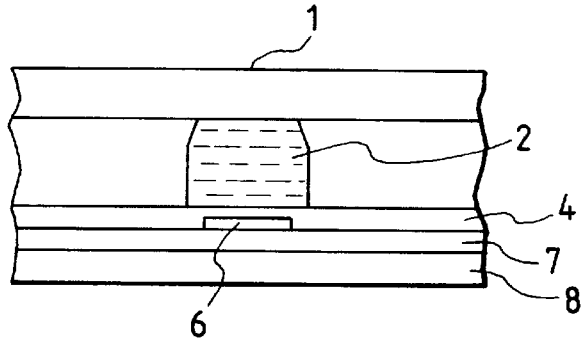
FIG. 3 is a transverse sectional view of the head of the ink-jet recording apparatus.
Figure 4:
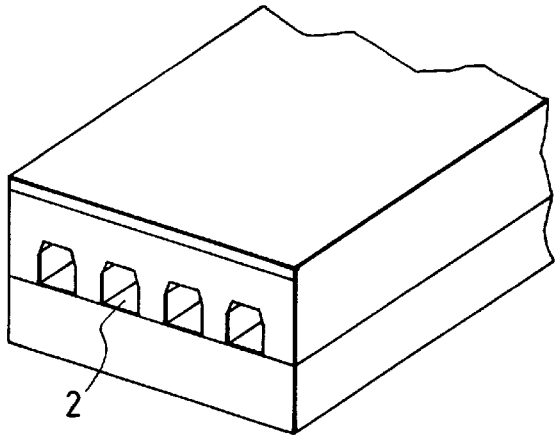
FIG. 4 is a schematic diagram illustrating an example of a head having a plurality of nozzles used in an ink-jet recording apparatus.

The recording method based on thermal energy will be described. FIGS. 2, 3, and 4 illustrate an example of the construction of a head which is a principal part of an ink-jet recording apparatus which operates using thermal energy.

FIG. 2 is a cross-sectional view of a head, taken along the flowing path of ink. In FIG. 2, the head 1 is obtained by bonding a heating element substrate 3 to a plate having a flowing path (nozzle) 2 of ink, made of glass, ceramic, silicon, or plastic. The heating element substrate 3 includes: a protection layer 4 made of silicon oxide, silicon nitride, silicon carbide, or the like; an electrode 5 made of aluminum, gold, aluminum-copper alloy, or the like; heat generating resistor layer 6 made of a high-melting point material such as $HfB_2$, TaN, TaAl, or the like; a heat storage layer 7 made of thermal silicon oxide, aluminum oxide, or the like; and a substrate 8 made of a material which can provide good heat radiation such as silicon, aluminum, aluminum nitride, or the like.

FIG. 3 is a transverse sectional view of the head 1 shown 3—3 in FIG. 2.

If an electrical signal in a pulse form is applied to the electrode 5 of the head 1 having the structure described above, the temperature of the region h of the heating element substrate 3 rises quickly. As a result, bubbles are created in the ink in the region in contact with the surface of the heating element substrate 3. The pressure of the bubbles makes a meniscus 10 project toward the outside. As a result, ink is ejected via a nozzle 2 of the head 1. Thus, ink droplets 12 in a spherical form are fired from an orifice 11 toward a recording medium 13. FIG. 4 illustrates the outside appearance of a multihead including a plurality of heads shown in FIG. 2.

Figure 5:
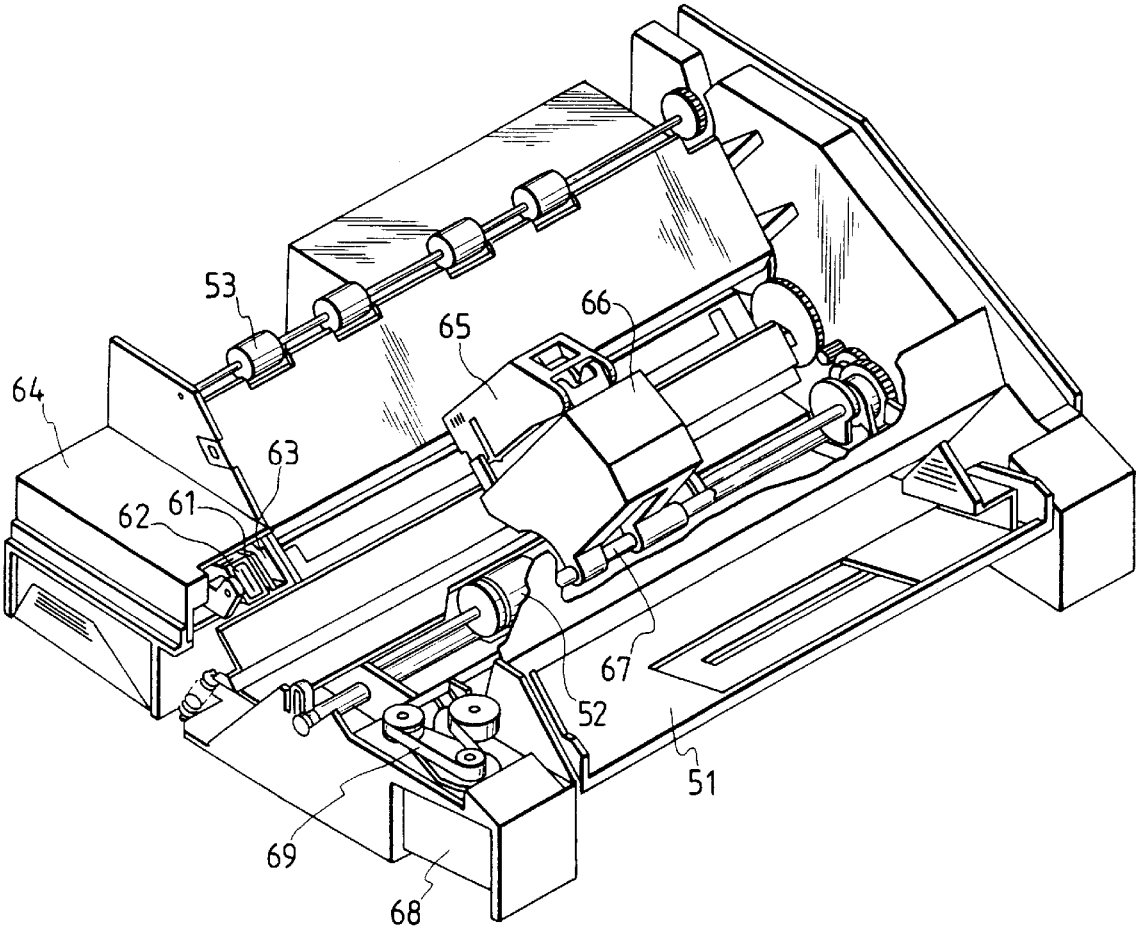
FIG. 5 is a perspective view illustrating an example of an ink-jet recording apparatus.

FIG. 5 illustrates an example of an ink-jet recording apparatus on which the head described above is mounted.

In FIG. 5, reference numeral 61 denotes a blade 61 serving as a wiping member. One end of the blade 61 is held by a blade holding member in such a manner as to form a cantilever. The blade 61 is disposed at a location adjacent to a recording area in which the recording operation is performed by the recording head 65. The blade 61 is held in such a manner that it projects into the middle of the moving path of the recording head 65 Reference numeral 62 denotes a cap for covering the ink discharge orifice plane of the recording head 65. The cap 62 is disposed at a home position adjacent to the blade 61 so that the cap 62 can move in a direction perpendicular to the moving direction of the recording head 65 and can come into contact with the ink discharge orifice plane thereby covering the orifice with the cap. Reference 63 denotes an ink absorbing member disposed adjacent to the blade 61, As in the case of the blade 61, the ink absorbing member 62 is also held in such a manner that it projects into the middle of the moving path of the recording head 65.

The blade 61, the cap 62, and the ink absorbing member 62 form a discharge refreshing member 64 for removing water, dust, particles, etc. from the surface of the ink discharge orifice.

The recording head 65 has ejection energy generation means by which ink is ejected toward a recording tedium disposed in parallel to the discharge orifice plane having discharge orifices so that a desired image is recorded on the recording medium. The recording head 65 is mounted on a carriage 66 so that the recording head 65 is carried to a desired location by the carriage 66.

The carriage 66 is engaged with a guide shaft 67 in such a manner that the carriage can slide along the guide shaft 67. A part of the carriage 66 is connected to a belt 69 which is driven by a motor 68. In this structure, the carriage 66 moves along the guide 67 so as to carry the recording head 65 to a desired position within the recording area and also to carry it out from the recording area.

Reference numeral 51 denotes a paper feeding portion via which a recording medium is fed into the apparatus. Reference 52 denotes a paper carrying roller which is driven by a motor(not shown). In the above structure, a recording medium is fed to a position parallel to the discharge orifice plane of the recording head 65. With the progress of the recording operation, the recording medium is moved toward a paper feeding out portion where paper feeding-out rollers 53 are disposed.

When the recording head 65 returns to the home position after completion of a recording operation or for other reasons, although the cap 62 of the discharge refreshing member 64 is located at a position aside from the moving path of the recording head 65, the blade 61 remains in the middle of the moving path of the recording path 65 so that the discharge orifice plane of the recording head 65 is wiped by the blade 61. When it is desired that the discharge orifice plane be capped by the cap 62, the cap 62 projects into the middle of the moving path of the recording head so that the cap 62 comes in contact with the discharge orifice plane of the recording head 65 and the discharge orifice plane is covered with the cap 62.

When the recording head 65 moves from its home position toward a recording start position, the cap 62 and the blade 61 are both at the same locations as they are when the above wiping is performed. As a result, the discharge orifice plane of the recording head 65 is also wiped during the travel from the home position to the recording start position.

The recording head 65 returns to its home position adjacent to the recording area not only at the end of a recording operation or at the time when discharge refreshing is required, but also it returns there periodically during a recording operation. The wiping is performed each time the recording head returns to the home position.

Figure 6:
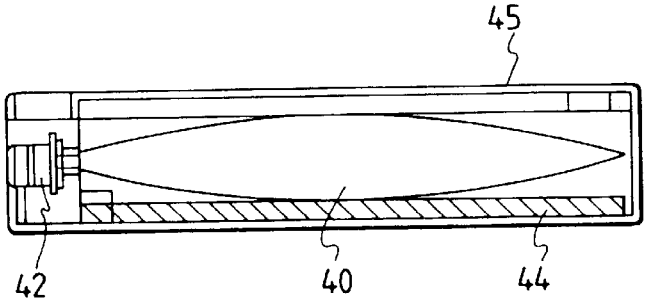
FIG. 6 is a longitudinal sectional view illustrating an example of an ink cartridge.

FIG. 6 is a schematic diagram illustrating an example of an ink cartridge 45 for storing ink which is supplied to the head via an ink supplying member such as a tube.

In FIG. 6, reference numeral 40, denotes an ink storing member such as an ink bag at an end of which there is provided a rubber stopper 42. A needle (not shown) is inserted through the rubber stopper 42 so that the ink can be supplied from the inside of the ink bag 40 to the head via the needle. Reference numeral 44 denotes an ink absorbing member for accepting waste ink.

In the ink storing member 40 for use in the present invention, its surface in contact with ink is preferably made up of polyolefin, in particular, polyethylene.

Figure 7:
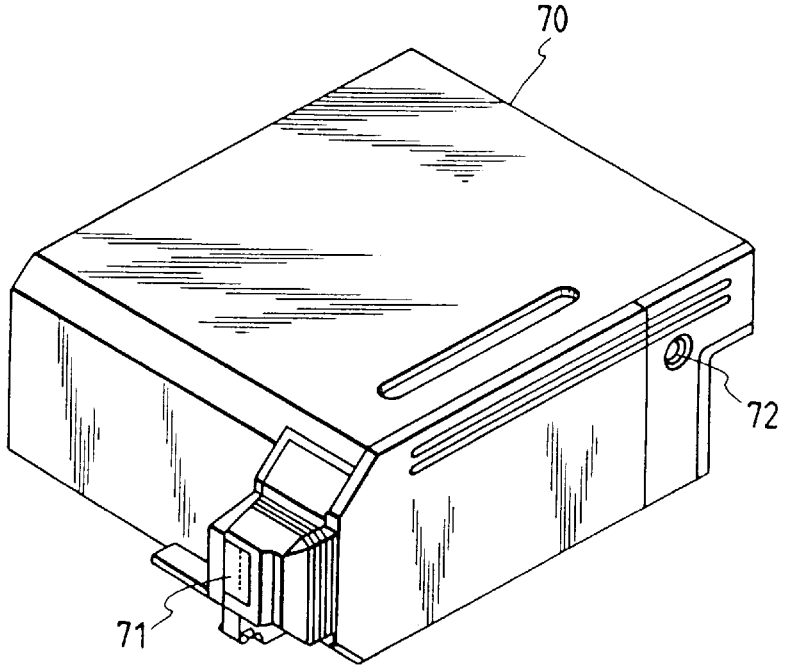
FIG. 7 is a perspective view illustrating an ink-jet recording head provided with an ink cartridge integrated with the ink-jet recording head.

The present invention can be applied not only to an ink-jet recording apparatus in which a recording head and an ink cartridge are disposed separately as in the example described above, but also to an ink-jet recording apparatus in which a recording head and an ink cartridge are formed in an integral fashion as shown in FIG. 7.

In FIG. 7, reference numeral 70 denotes a recording unit including an ink storing member, such as an ink absorbing member. The ink stored in the ink storing member is supplied to a head part 71, and ejected in the form of droplets via a plurality of orifices.

In the present invention, the ink absorbing member is preferably made up of polyurethane. Instead of using the ink absorbing member, the ink storing member may also be constructed with an ink bag in which a spring or the like is disposed. Reference numeral 72 denotes an atmospheric duct via which the inside of the recording unit can communicate with the outer atmosphere. The recording unit 70 described here in FIG. 7 can be employed instead of the recording head shown in FIG. 5. The recording unit 70 can be mounted in a removable fashion on the carriage 66.

Formula (11) which theoretically represents an ideal heat flux should be modified slightly so as to represent more precisely the actual heat conduction. Thus, the present invention will be described in greater detail with reference to specific embodiments and also comparative examples, in which some examples of practical values of the heat flux will be shown.

First, the method of driving the ink-jet recording head will be described. In the following description, it is assumed that the ink has a transition temperature of 65° C. and that the average temperature of ink is raised to about 70° C. from 25° C. before being ejected.

COMPARATIVE EXAMPLE 1

Figure 9:
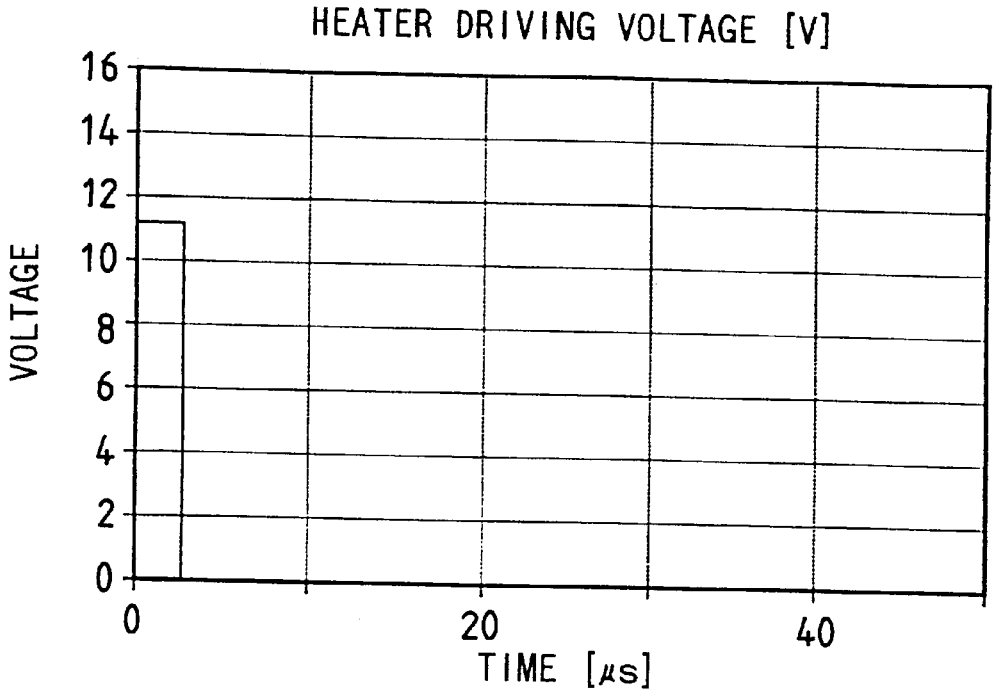
FIG. 9 is a graph illustrating the driving voltage applied to a heater in a comparative example 1.
Figure 10:
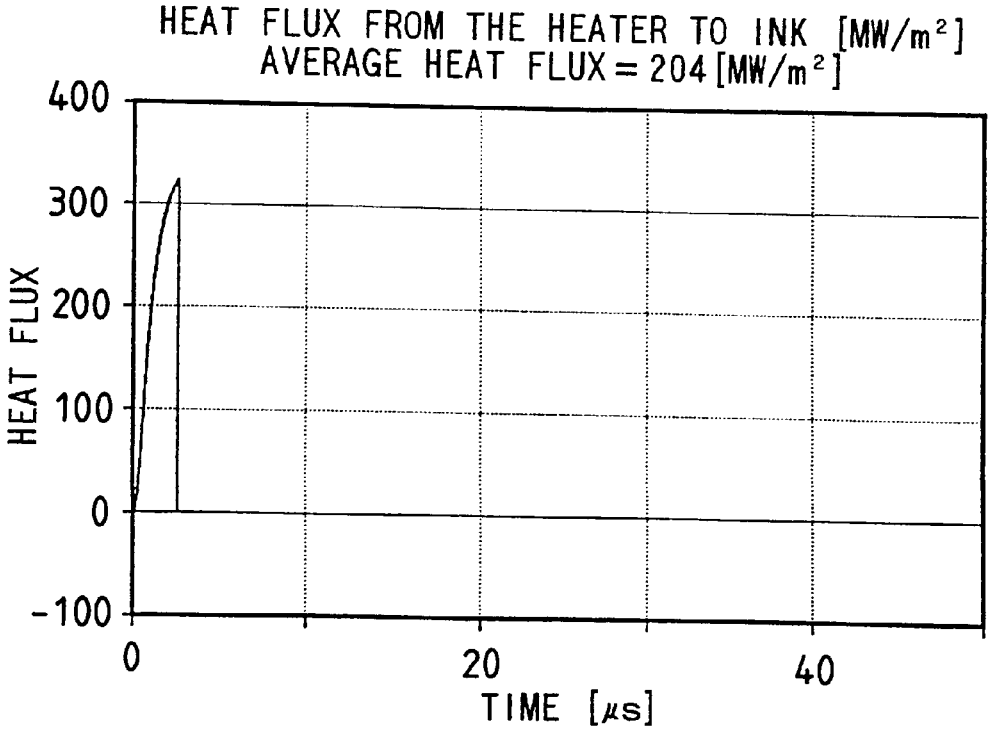
FIG. 10 is a graph illustrating the heat flux from the heater to ink as a function of time, in the comparative example 1.

In this comparative example 1, a recording head is constructed using a heating element (heater) having a structure denoted by "A" in Table 1. The heater includes: an Si substrate; a 1.0 μm thick silicon oxide layer ($SiO_2$) formed on the Si substrate; a 0.065 μm thick heater layer of $HfB_2$ (with a sheet resistance of 58.6Ω); a 1 μm thick protection layer of $SiO_2$; and an anti-cavitation layer having a multi-layer structure consisting of a 0.05 μm thick tantalum pentoxide ($Ta_2O_5$) and a 0.6 μm thick tantalum (Ta). The heater has a size of 24 μm×28 μm wherein a current flows in a direction along longer sides of the heater. The total resistance including those of the heater and interconnections is 92Ω. If a voltage of 11.3 V is applied to the external circuit connected to the heater for 2.6 μsec. as shown in FIG. 9, then the temperature of ink present near the surface of the heater reaches 300° C. when about 2.55 μsec. has elapsed after the application of the driving voltage, and film boiling occurs, which results in creation of bubbles. Thus, ink droplets are ejected by the bubbles. At this stage, the average temperature of the ink present within the 10 μm range from the surface of the heater has risen to about 35.5° C. from the initial temperature of 25° C. The average temperature can be easily determined by using a graph similar to that shown in FIG. 8. The driving method described above is widely used in conventional techniques. FIG. 10 is a graph illustrating the heat flux obtained under the above conditions. In this graph, after the heat flux has increased very quickly but smoothly, it suddenly drops down to 0 at 2.55 μsec. This sudden drop in temperature is due to the creation of a bubble at the surface of the heater. That is, the surface of the heater is covered with a bubble or gas which provides thermal insulation and thus the heat flux becomes 0. After that, the temperature of the surface of the heater increases very quickly. However, in this technique, the average temperature of the ink within the 10 μm range from the surface of the heater does not become high enough for the purpose of the invention, because the too great heat flux emerging from the surface of the heater makes the temperature of the ink in the region near the surface of the heater exceed the bubble creation temperature or more specifically 300° C., before an enough amount of heat has been transferred to the ink. In this comparative example 1, the average heat flux is 204 $MW/m^2$.

SPECIFIC EMBODIMENT 1

Figure 15:
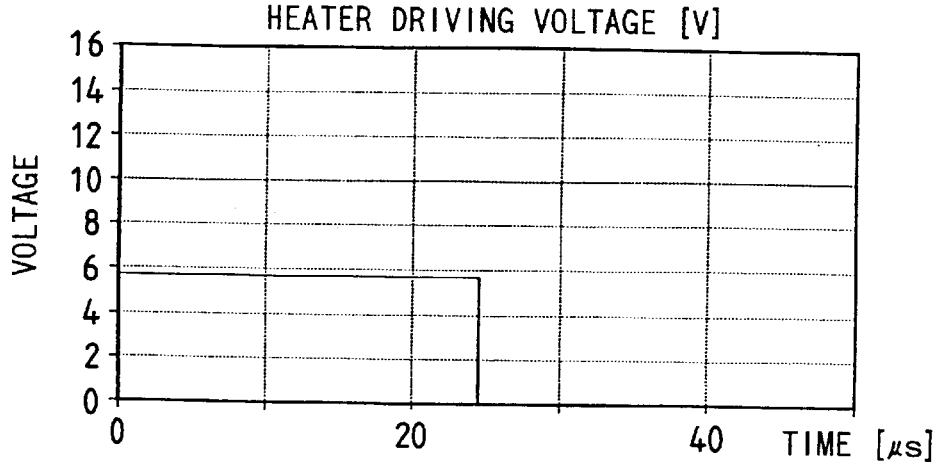
FIG. 15 is a graph illustrating the driving voltage applied to a heater in a specific embodiment 1 according to the invention.
Figure 16:
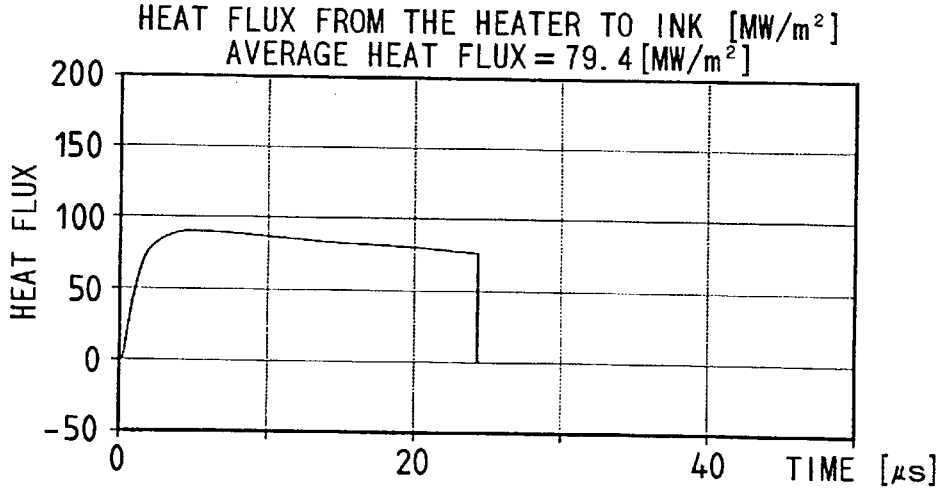
FIG. 16 is a graph illustrating the heat flux from the heater to ink as a function of time, in the specific embodiment 1 according to the invention.
Figure 17:
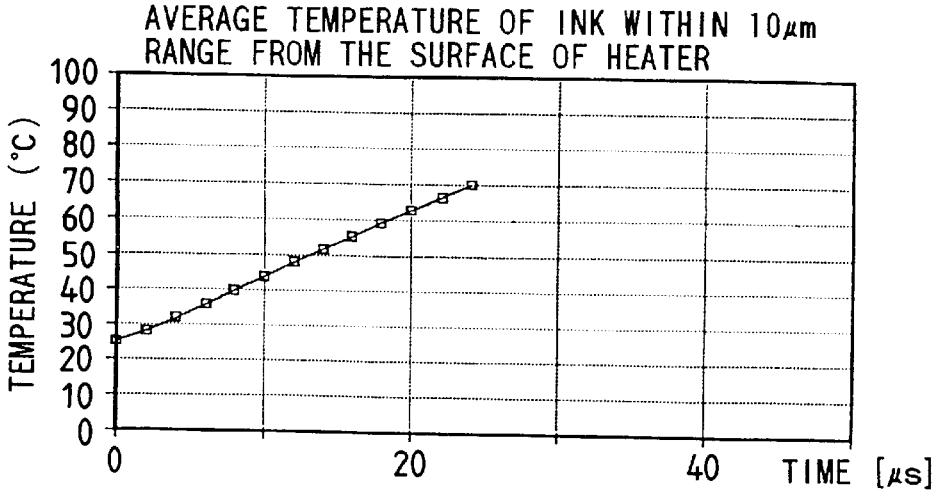
FIG. 17 is a graph illustrating the average temperature of the ink within the 10 $\mu$m range from the surface of the heater as a function of time for the case of the specific embodiment 1 according to the invention.
Figure 18:
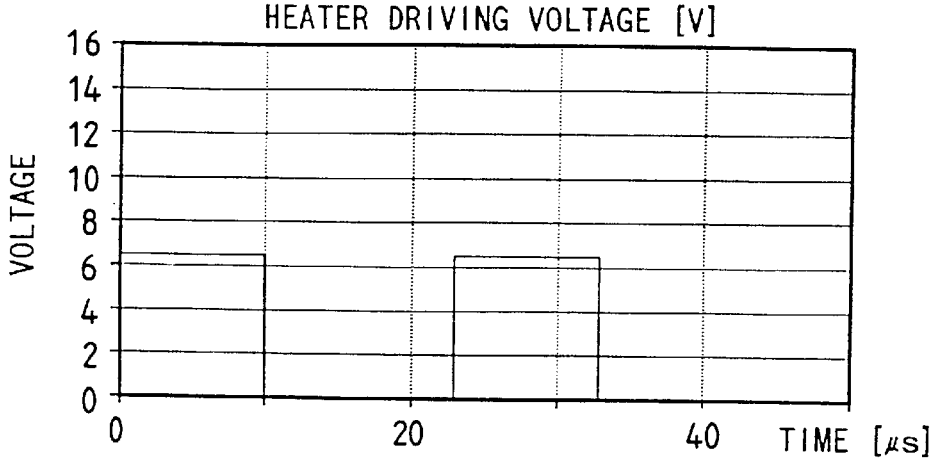
FIG. 18 is a graph illustrating the driving voltage applied to a heater in a specific embodiment 2 according to the invention.

In this specific embodiment 1, the same heater as that employed in the comparative example 1 is used. However, the heater is driven by a voltage in the form of a single pulse having a sufficiently low value to decrease the heat flux to a sufficiently low level. When the driving voltage is set to 5.7 V, the temperature of ink near the surface of the heater reaches 300° C. at about 24 μsec. and a bubble is created. At that time, the average temperature of the ink within the 10 μm range from the surface of the heater has become 69.7° C., which makes it possible to provide a sufficient amount of heat to the ink as opposed to the comparative example 1. Thus, this specific embodiment 1 can provide a great improvement. FIG. 15 illustrates the pulse for driving the heater. FIG. 16 illustrates the heat flux from the heater to the ink as a function of time. As can be seen from FIG. 16, the average heat flux before the creation of a bubble is 79.4 $MW/m^2$. FIG. 17 illustrates the average temperature of the ink within the 10 μm range from the surface of the heater as a function of time. In this specific embodiment, it is possible to heat the ink from 25° C. to about 70° C. without creating a bubble. The volume of the ink which receives the above heat flux can be determined by the area of the heater and the thickness of the ink as 24 μm×27 μm×10 μm=6.5 pl. In all specific embodiments of the invention as well as all comparative examples, the volume of ejected ink is assumed to be equal to the above value.

SPECIFIC EMBODIMENT 2

In the specific embodiment 1, since the heater is driven by a rather low voltage, there is a some possibility that nuclear boiling occurs instead of the film boiling. If nuclear boiling occurs, the surface of the heater is gradually covered with a number of small bubbles as opposed to the film boiling in which the surface of the heater is suddenly covered with water vapor. Whether the film boiling occurs or not depends greatly on the composition of ink, the roughness of the surface of the heater, and the degree of purification of ink. If nuclear boiling occurs, abrupt creation of water vapor is prevented, and as a result, the rate of ejection of ink droplets via nozzles decreases, which leads to degradation in the quality of a recorded image.

Figure 19:
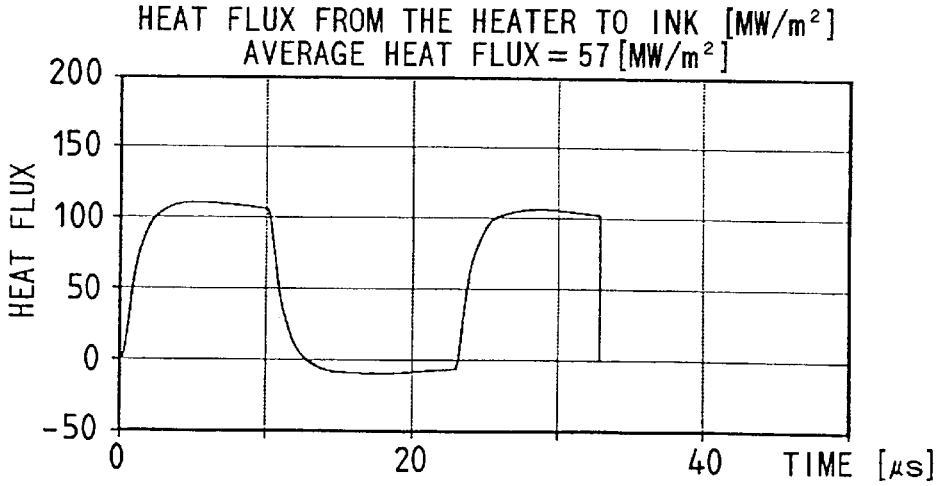
FIG. 19 is a graph illustrating the heat flux from the heater to ink as a function of time, in the specific embodiment 1 according to the invention.

In this specific embodiment 2, although the same heater as that employed in the specific embodiment 1 is used, double pulses having a slightly higher voltage are used to drive the heater so as to avoid the problem described above. More specifically., the driving voltage is set to 6.3 V, the width of a first pulse 10 μsec., the width of a second pulse 9.8 μsec., and the interval between the first and second pulses about 12 μsec. In this case, the average temperature of the ink within the 10 μm range from the surface of the heater becomes 68.1° C., which provides a similar effect to that in the specific embodiment 1. FIG. 19 illustrates the heat flux from the heater to ink as a function of time. In a short time after starting the application of the first pulse, the heat flux reaches a virtually constant value. At the end of the first driving pulse, the heat flux quickly drops down. In the graph shown in FIG. 19, the heat flux becomes negative during a time period until the start of the second driving pulse. This means that the temperatures of the heater and the silicon substrate become lower than the temperature of the ink in the region in contact with the surface of the heater, and, as a result, a small amount of heat transfer occurs from the ink to the heater and the silicon substrate. As a matter of course, heat diffusion also occurs within the ink, toward the direction opposite to the surface of the heater. In this case, the average heat flux before creation of bubble is about 57 $MW/m^2$. In this specific embodiment, the first pulse heats the ink to a temperature slightly lower the bubble creation temperature. After that, there is a short pause in which the heat concentrated in the region near the surface of the heater diffuses apart from the surface of the heater. When the temperature of the surface of the heater has dropped to a certain level, another pulse (the second driving pulse) is applied to the heater so that a bubble is finally created in the ink and thus ink is ejected. In this specific embodiment, the second pulse starts when the temperature of the ink in the region near the surface of the heater has dropped to about 100° C.

Figure 20:
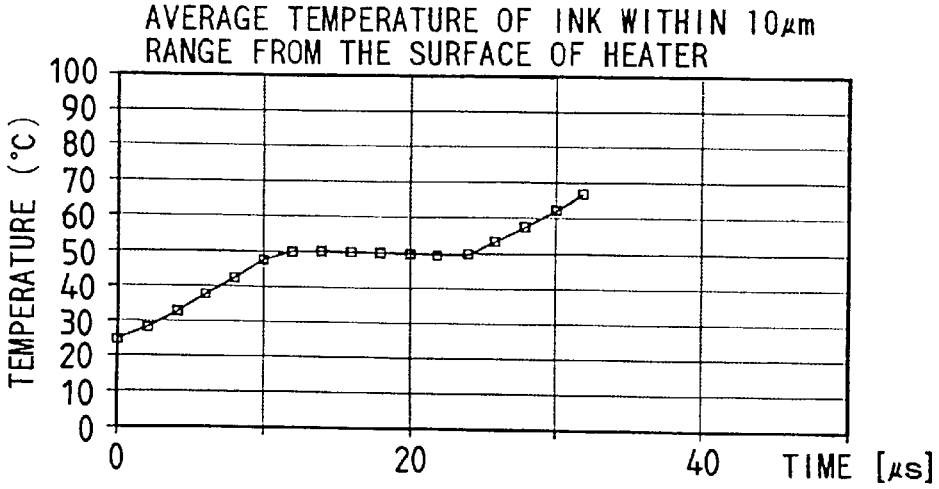
FIG. 20 is a graph illustrating the average temperature of the ink within the 10 $\mu$m range from the surface of the heater as a function of time for the case of the specific embodiment 2 according to the invention.

FIG. 20 illustrates the average temperature of the ink within the 10 μm range from the surface of the heater as a function of time. As can be seen from FIG. 20, the temperature remains substantially unchanged during the pause between two pulses.

SPECIFIC EMBODIMENT 3

Figure 21:
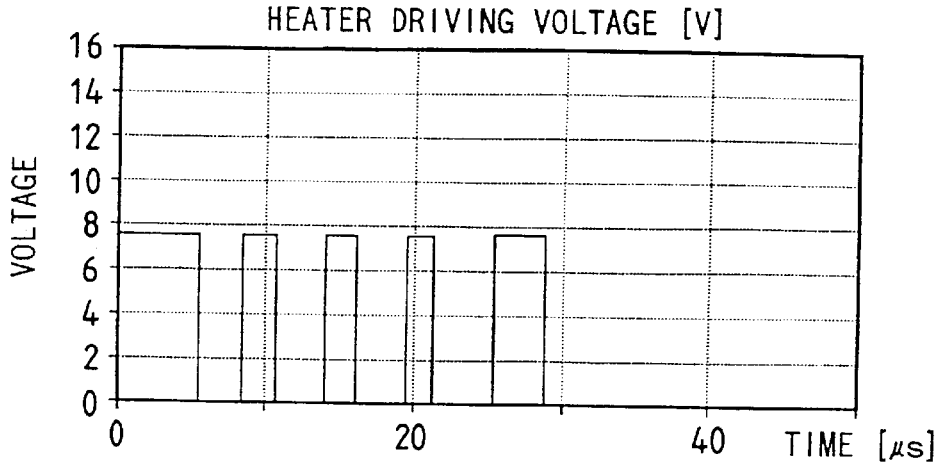
FIG. 21 is a graph illustrating the driving voltage applied to a heater in a specific embodiment 3 according to the invention.
Figure 22:
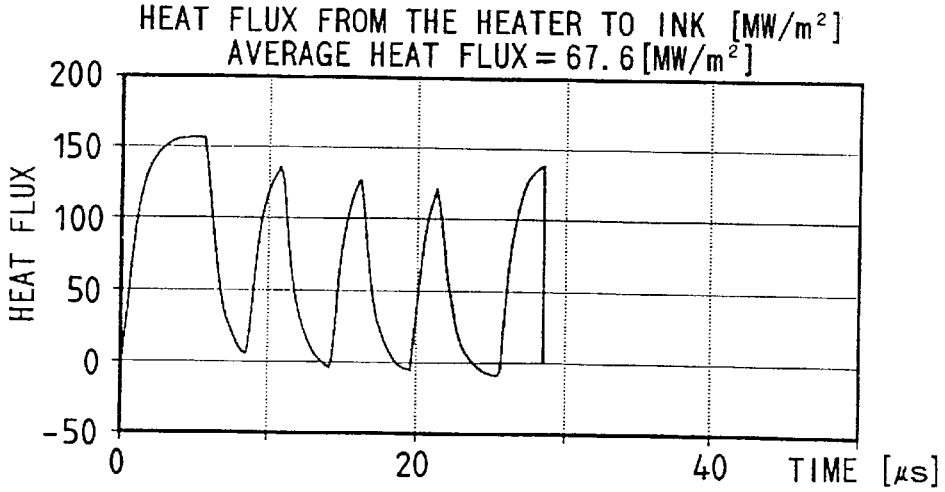
FIG. 22 is a graph illustrating the heat flux from the heater to ink as a function of time, in the specific embodiment 3 according to the invention.
Figure 23:
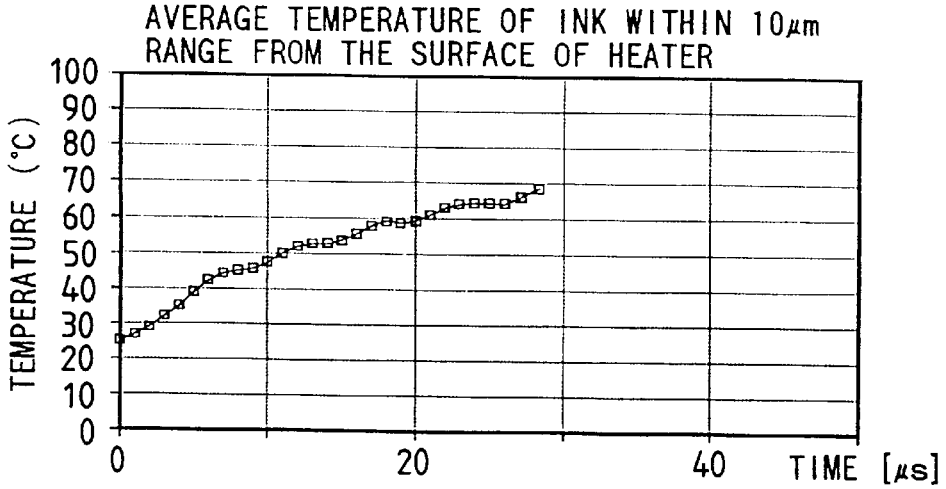
FIG. 23 is a graph illustrating the average temperature of the ink within the 10 $\mu$m range from the surface of the heater as a function of time for the case of the specific embodiment 3 according to the invention.

In this specific embodiment, a higher driving voltage is employed. The same heater as that used in the specific embodiment 1 is also employed here. However, the driving voltage is set to 7.5 V. In this embodiment, as shown in FIG. 21, five pulses are used to drive the heater thereby heating ink. In this case, the heat flux from the heater to the ink occurs in a pulse fashion in response to the driving voltage, as shown in FIG. 22. In this driving technique, the peak value of the heat flux becomes greater than 100 $MW/m^2$. In particular, at the time when a bubble is created, the heat flux becomes as high as 140 $MW/m^2$. As a result, strong and stable creation of a bubble occurs. As shown in FIG. 23, the average temperature of the ink within the 10 $\mu$m range from the surface of the heater reaches 69.5° C. when the creation of a bubble occurs, and thus a similar effect to that in the embodiment 1 or 2 can be obtained. In this specific embodiment, each pulse starts when the temperature of the ink in the region near the surface of the heater has dropped to about 180° C.

COMPARATIVE EXAMPLE 2

Figure 11:
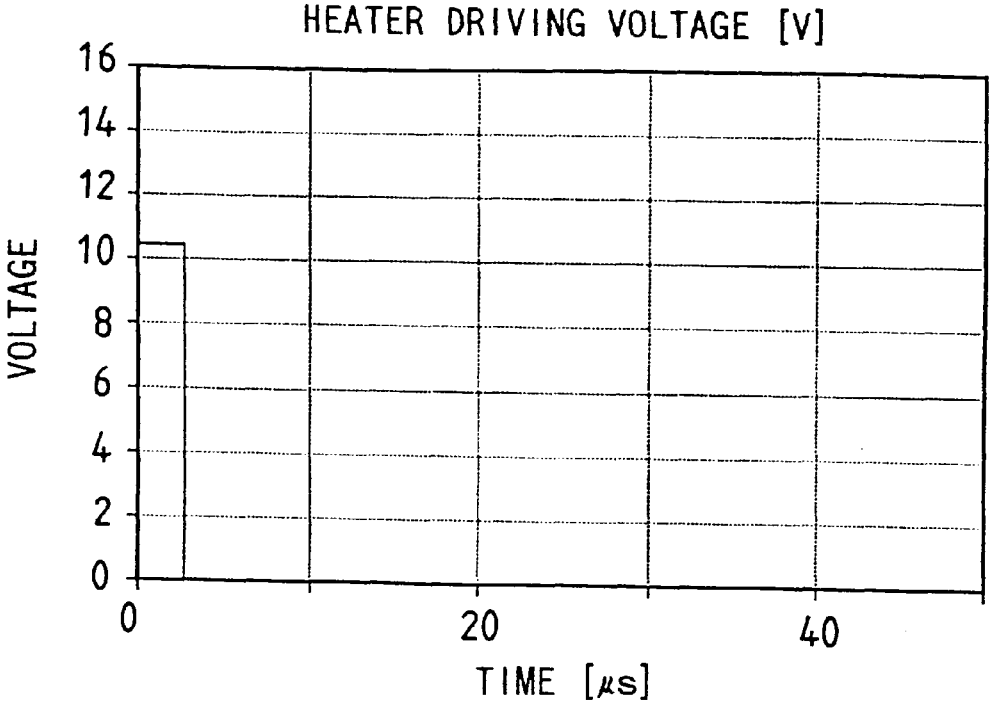
FIG. 11 is a graph illustrating the driving voltage applied to a heater in a comparative example 2.
Figure 12:
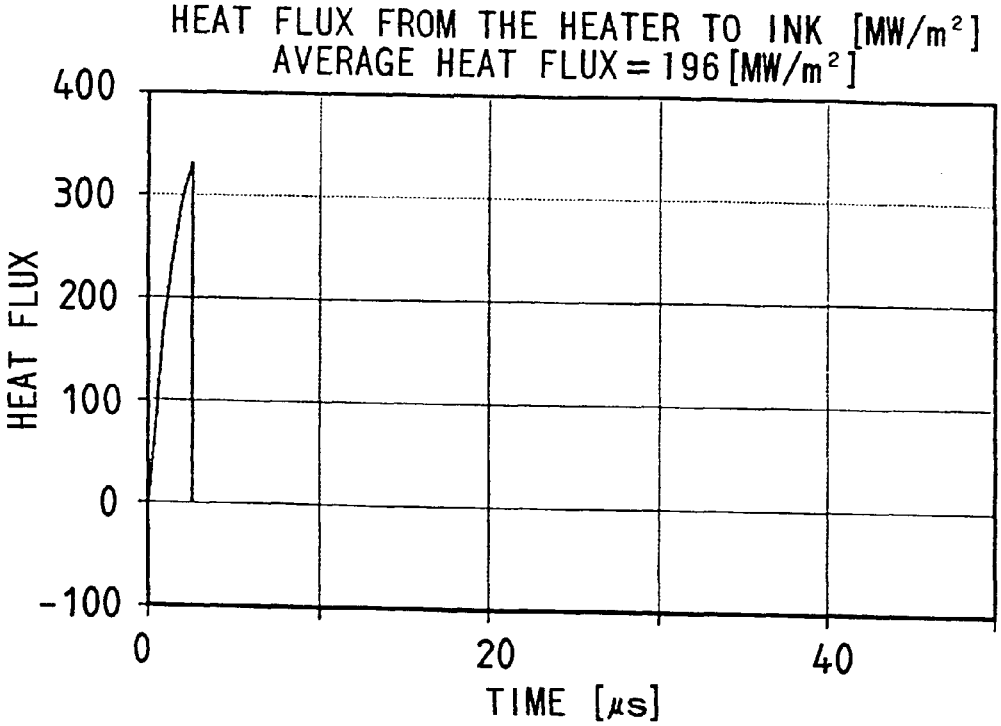
FIG. 12 is a graph illustrating the heat flux from the heater to ink as a function of time, in the comparative example 2.

In this comparative example 2, a heater of the type denoted by "B-(1)" in Table 1 is employed. The difference from the heater A is that while in the case of the heater A the thickness of the silicon oxide layer formed on the silicon substrate is 1.0 $\mu$m, the thickness of that of the heater B-(1) is as great as 6.0 $\mu$m. This silicon oxide film serves to reduce the amount of heat diffusing from the heater toward the silicon substrate. A voltage is applied to this heater in accordance with the conventional driving technique, as shown in FIG. 11. Although in the comparative example 1, the voltage of 11.3 V is applied to the heater having the structure A, a voltage of 10.5 V is employed here in the comparative example 2. FIG. 12 illustrates the heat flux from the heater to ink as a function of time. As can be seen, the heat flux occurs in a similar manner to the comparative example 1 shown in FIG. 10. The average heat flux is 196 $MW/m^2$, which is also similar to that in the comparative example 1. This means that it is possible to generate a similar heat flux with driving voltages having different voltages.

SPECIFIC EMBODIMENT 4

Figure 24:
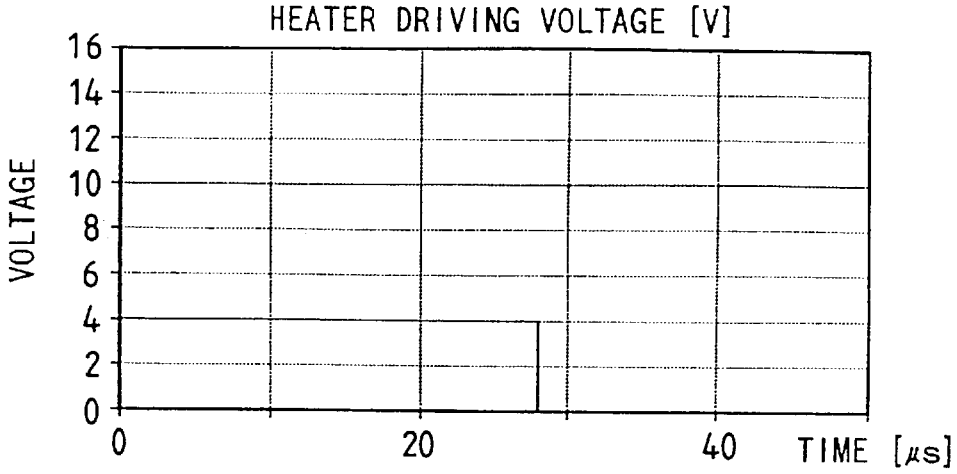
FIG. 24 is a graph illustrating the driving voltage applied to a heater in a specific embodiment 4 according to the invention.
Figure 25:
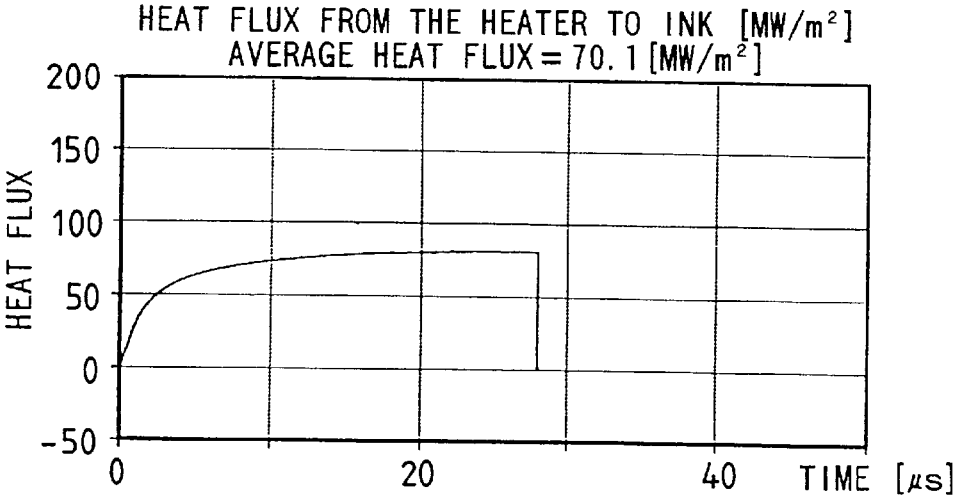
FIG. 25 is a graph illustrating the heat flux from the heater to ink as a function of time, in the specific embodiment 4 according to the invention.
Figure 26:
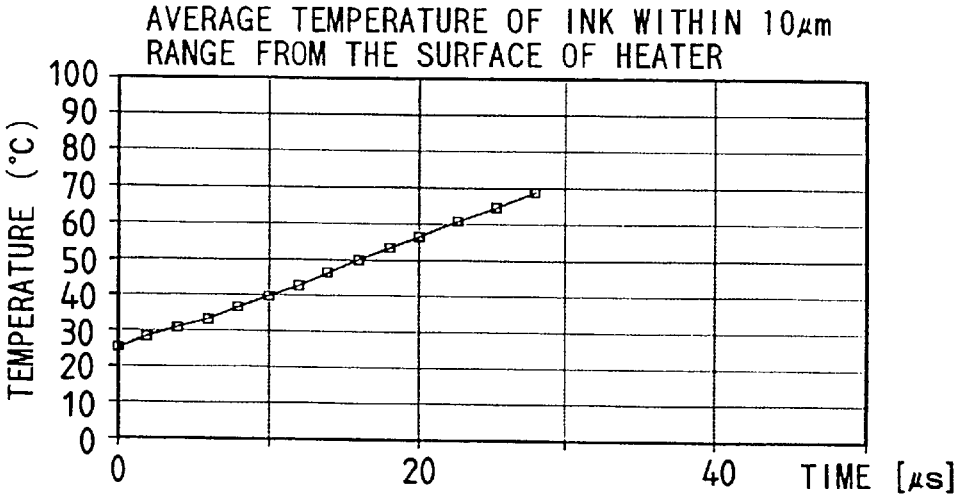
FIG. 26 is a graph illustrating the average temperature of the ink within the 10 $\mu$m range from the surface of the heater as a function of time for the case of the specific embodiment 4 according to the invention.

The same heater as that employed in the comparative example 2 is employed here in the specific embodiment 4. A voltage in the form of a single pulse such as that shown in FIG. 24 is used to drive the heater. More specifically, the voltage of the driving pulse is set to 4.0 V. FIG. 25 illustrates the heat flux from the heater to ink as a function of time. As can be seen, the average heat flux is 70.1 $MW/m^2$. FIG. 24 illustrates the average temperature of the ink within the 10 $\mu$m range from the surface of the heater as a function of time.

SPECIFIC EMBODIMENT 5

Figure 30:
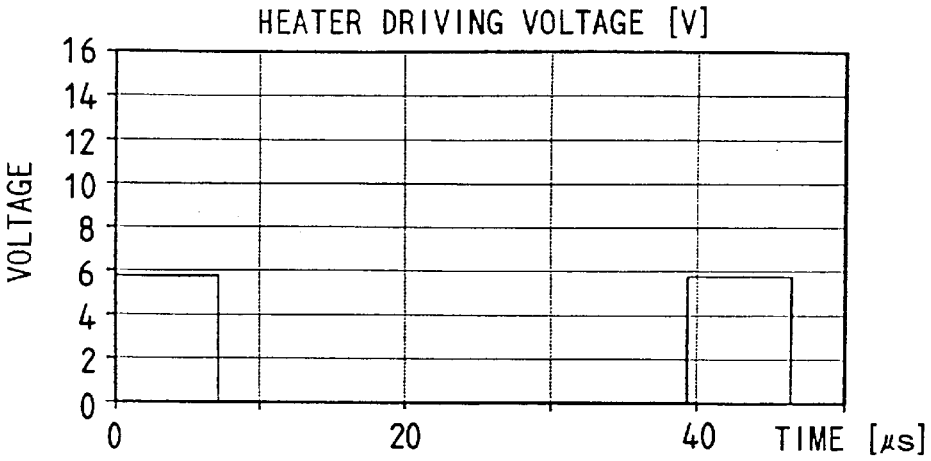
FIG. 30 is a graph illustrating the driving voltage applied to a heater in a specific embodiment 5 according to the invention.
Figure 31:
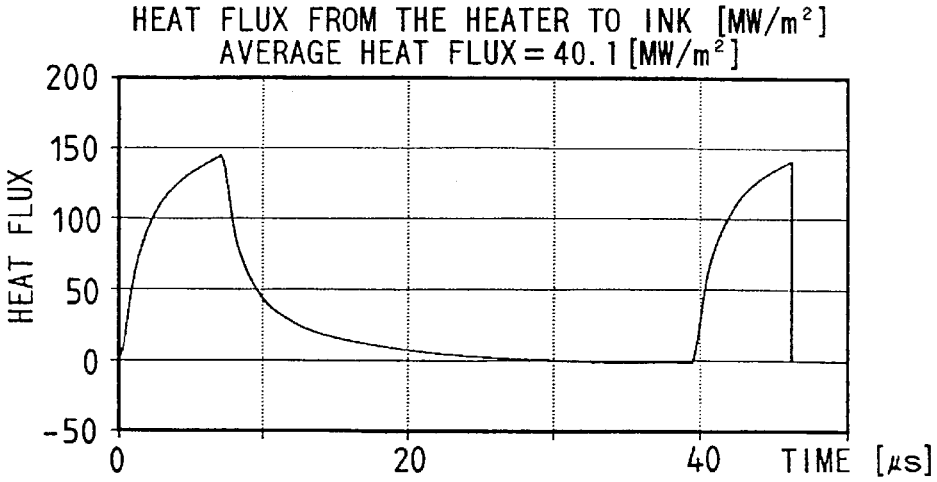
FIG. 31 is a graph illustrating the heat flux from the heater to ink as a function of time, in the specific embodiment 5 according to the invention.
Figure 32:
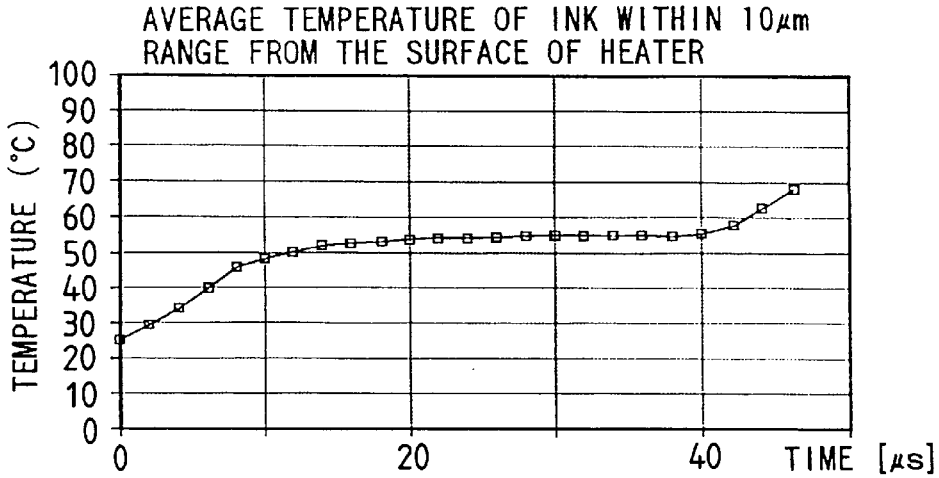
FIG. 32 is a graph illustrating the average temperature of the ink within the 10 $\mu$m range from the surface of the heater as a function of time for the case of the specific embodiment 5 according to the invention.

In this specific embodiment, the same heater as that employed in the specific embodiment 4 is also used. However, the heater is driven by double pulses having a voltage of 5.8 V, as shown in FIG. 30. FIG. 31 illustrates the heat flux from the heater to ink as a function of time. As can be seen from FIG. 31, the average heat flux is 40.1 $MW/m^2$. In this embodiment, heat transfer in a reverse direction is small compared to the case of the specific embodiment 2 shown in FIG. 19. The above small reverse heat transfer is brought about by the high degree of heat insulation by the silicon oxide layer as thick as 6.0 $\mu$m formed on the silicon substrate, as opposed to the specific embodiment 2 in which the silicon oxide layer is as thin as 1.0 $\mu$m. FIG. 32 illustrates the average temperature of the ink within the 10 $\mu$m range from the surface of the heater as a function of time. As can be seen from FIG. 32, the average temperature of the ink within the 10 $\mu$m range from the surface of the heater reaches 69.8° C.

SPECIFIC EMBODIMENT 6

Figure 27:
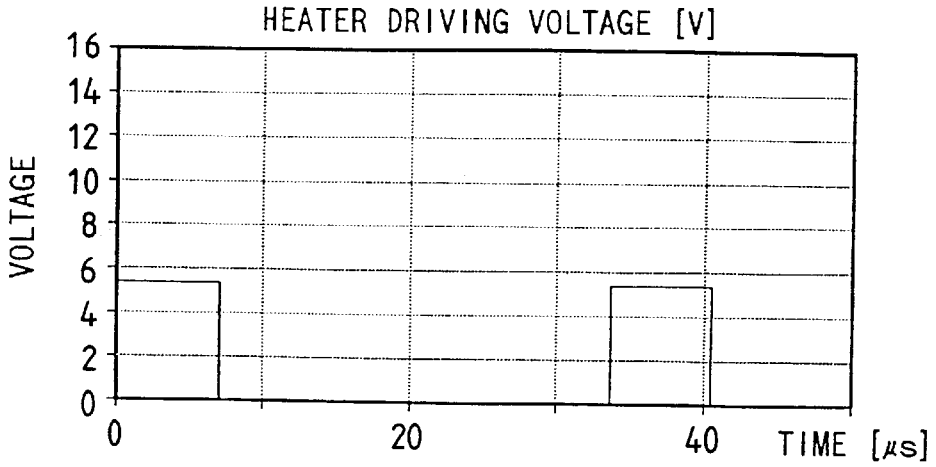
FIG. 27 is a graph illustrating the driving voltage applied to a heater in a specific embodiment 6 according to the invention.
Figure 28:
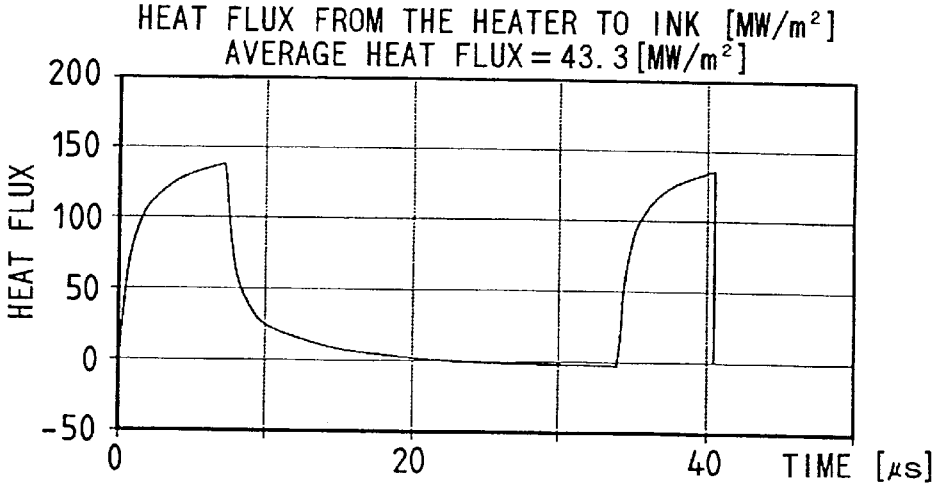
FIG. 28 is a graph illustrating the heat flux from the heater to ink as a function of time, in the specific embodiment 6 according to the invention.
Figure 29:
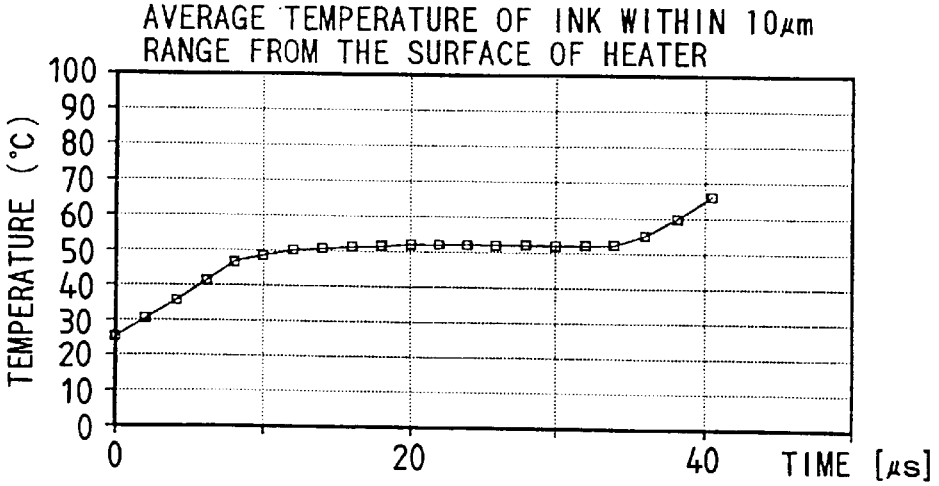
FIG. 29 is a graph illustrating the average temperature of the ink within the 10 $\mu$m range from the surface of the heater as a function of time for the case of the specific embodiment 6 according to the invention.

In this specific embodiment, a heater having the structure denoted by B-(2) in Table 1 is employed, In this heater, although the thickness of the silicon oxide layer is 6 $\mu$m as the heater B-(1) employed in the specific embodiment 5, the thickness of the protection layer is 0.5 $\mu$m which is a half that of the protection layer of the heater B-(1). This heater is driven by double pulses. The protection layer serves to protect the heating element from the corrosion by ink. The reduction in the thickness of the protection layer results in an improvement in the heat efficiency. FIG. 27 illustrates the pulses used to drive the heater, and FIG. 28 illustrates the heat flux from the heater to ink as a function of time. As can be seen from FIG. 28, the average heat flux is 43.3 $MW/m^2$. FIG. 29 illustrates the average temperature of the ink within the 10 $\mu$m range from the surface of the heater as a function of time.

COMPARATIVE EXAMPLE 3

Figure 13:
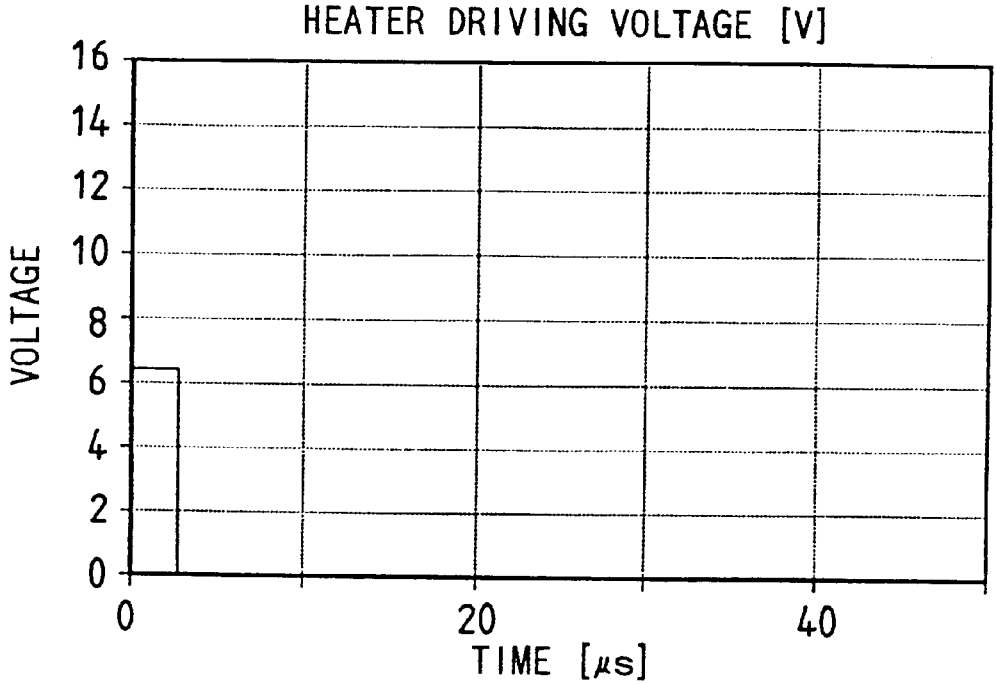
FIG. 13 is a graph illustrating the driving voltage applied to a heater in a comparative example 3.
Figure 14:
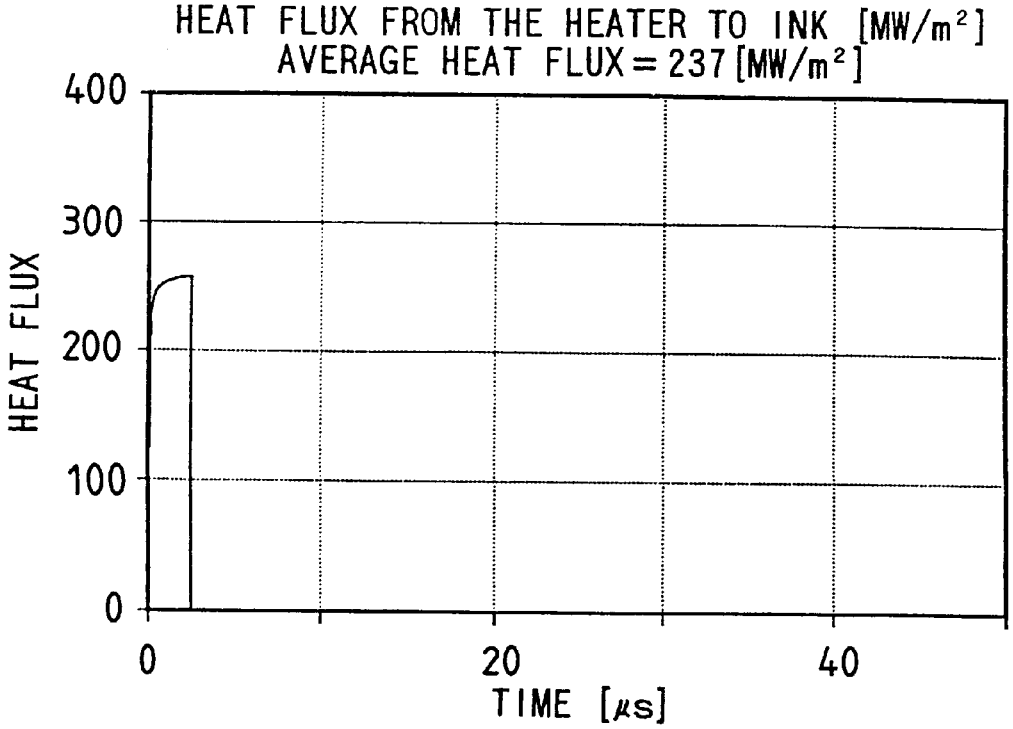
FIG. 14 is a graph illustrating the heat flux from the heater to ink as a function of time, in the comparative example 3.

In this example, a heater having the structure denoted by C in Table 1 is employed. In this heater, a heating material layer ($HfB_2$) is formed directly on a glass substrate so that ink can be in direct contact with the heating layer and thus is heated directly by the heating layer or ink can be in contact with the heating layer via a thin film and thus is heated via that thin film. This heater provides a very high heating efficiency. The heater is driven by a voltage in accordance with the conventional driving technique as shown in FIG. 13. FIG. 14 illustrates the heat flux from the heater to ink as a function of time. As can be seen from FIG. 14, the average heat flux during the time period from the start of heating to the time when a bubble is created is 237 $MW/m^2$.

SPECIFIC EMBODIMENT 7

Figure 33:
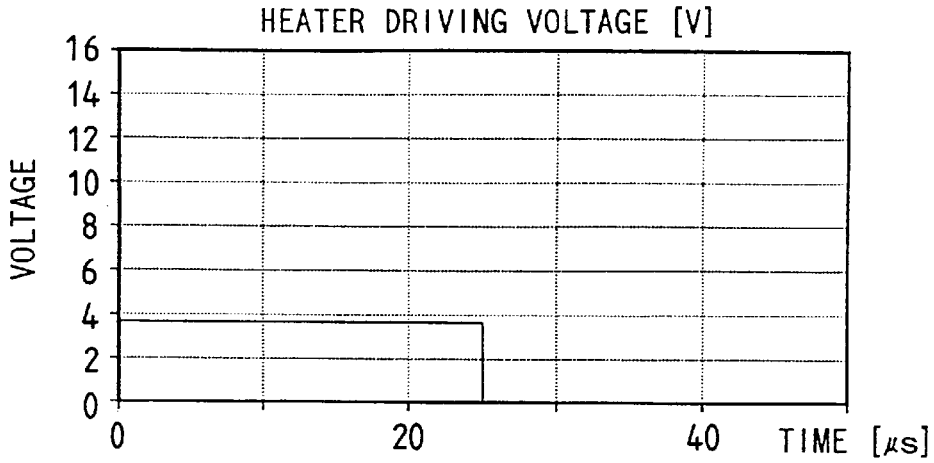
FIG. 33 is a graph illustrating the driving voltage applied to a heater in a specific embodiment 7 according to the invention.
Figure 34:
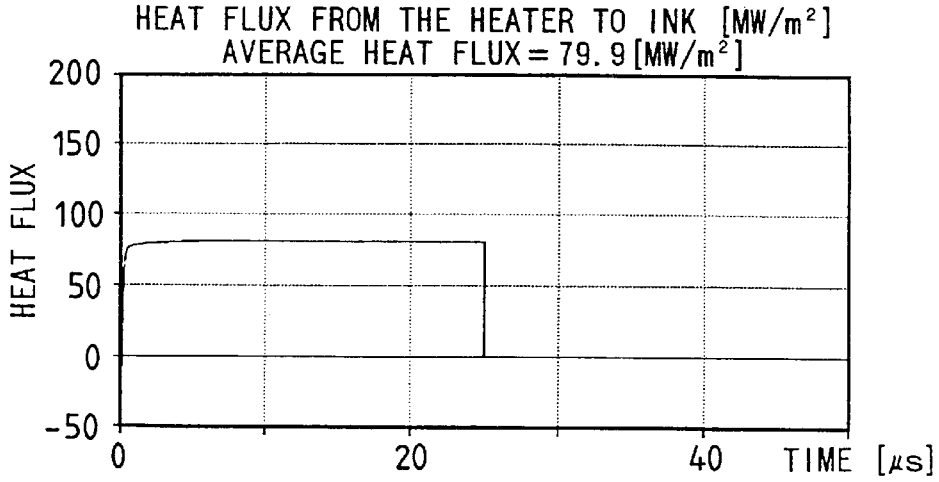
FIG. 34 is a graph illustrating the heat flux from the heater to ink as a function of time, in the specific embodiment 7 according to the invention.
Figure 35:
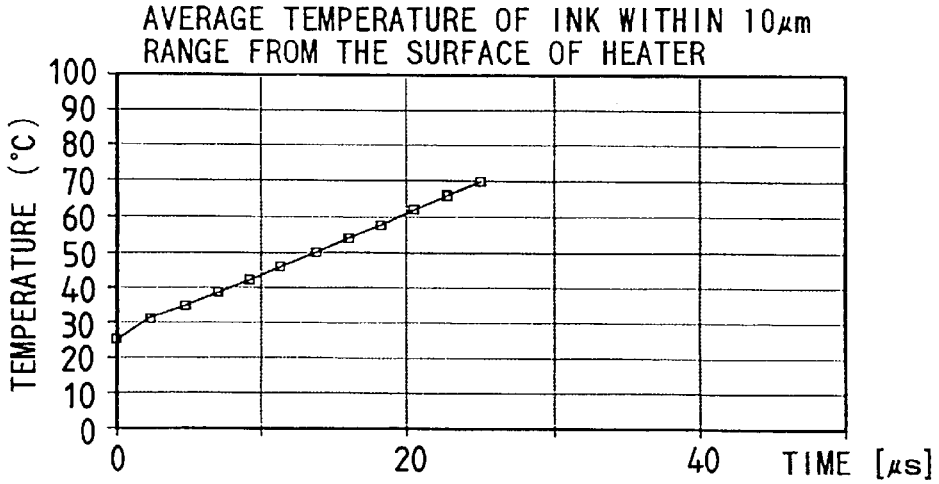
FIG. 35 is a graph illustrating the average temperature of the ink within the 10 $\mu$m range from the surface of the heater as a function of time for the case of the specific embodiment 7 according to the invention.
Figure 36:
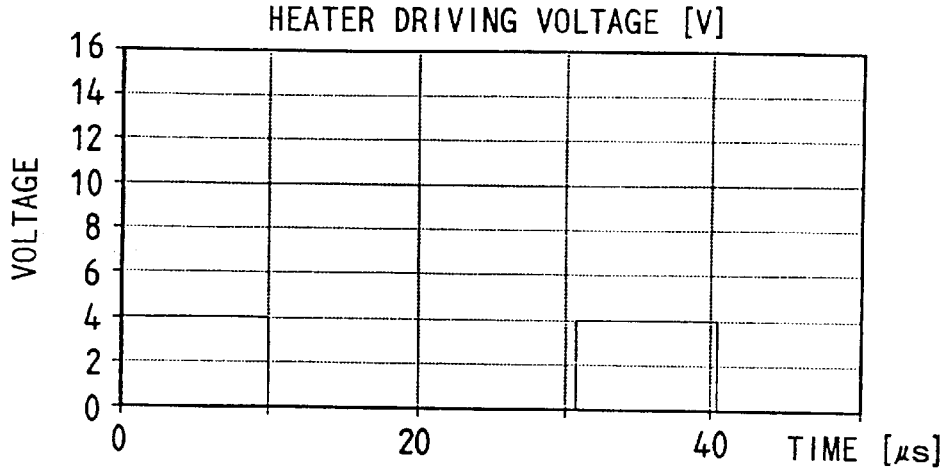
FIG. 36 is a graph illustrating the driving voltage applied to a heater in a specific embodiment 8 according to the invention.

The same heater as that used in the comparative example 3 is used here in the specific embodiment 7. This heater is driven by a voltage of the form of a single pulse as shown in FIG. 33, wherein the driving voltage is set to 3.6 V. FIG. 35 illustrates the heat flux from the heater to ink as a function of time. As can be seen from FIG. 35, the average heat flux is 79.9 $MW/m^2$. FIG. 36 illustrates the average temperature of the ink within the 10 $\mu$m range from the surface of the heater as a function of time. As can be seen, the average temperature reaches 70° C.

SPECIFIC EMBODIMENT 8

Figure 37:
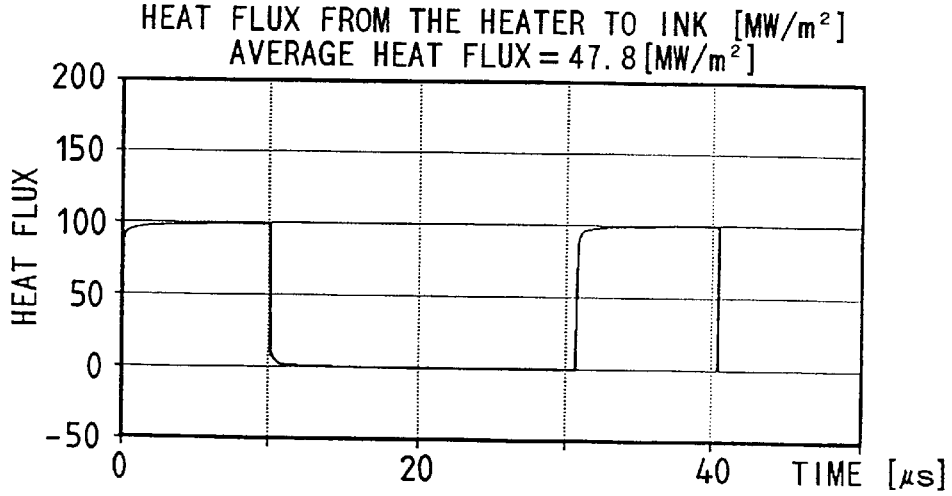
FIG. 37 is a graph illustrating the heat flux from the heater to ink as a function of time, in the specific embodiment 8 according to the invention.
Figure 38:
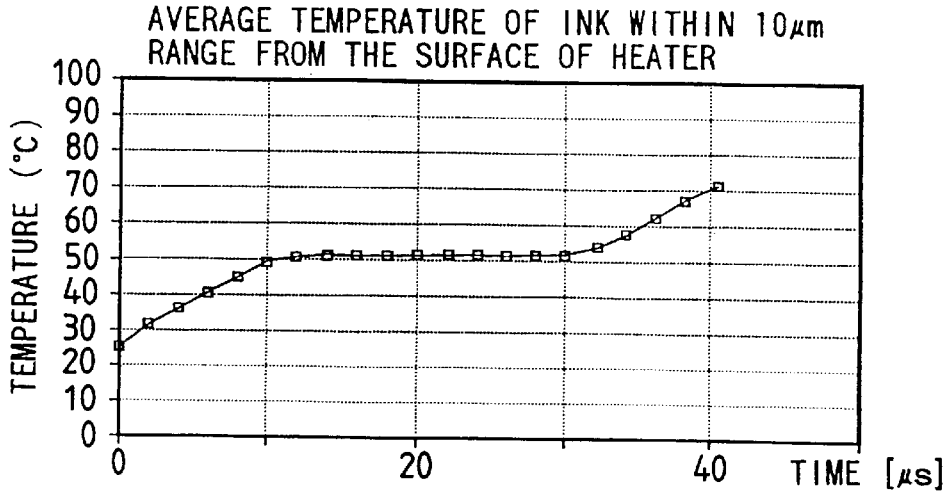
FIG. 38 is a graph illustrating the average temperature of the ink within the 10 $\mu$m range from the surface of the heater as a function of time for the case of the specific embodiment 8 according to the invention.

The same heater as that employed in the specific embodiment 7 is also used in this specific embodiment 8. However, the heater is driven by double pulses with a voltage of 4.0 V shown in FIG. 36. FIG. 37 illustrate the heat flux from the heater to ink as a function of time. The heater employed here in this embodiment has no oxide layer (protection layer), and thus the graph representing the heat flux from the heater to ink has a similar shape to the waveform of driving voltage shown in FIG. 36. As can be seen from FIG. 37, the average heat flux is 47.8 $MW/m^2$. FIG. 38 illustrates the average temperature of the ink within the 10 $\mu$m range from the surface of the heater as a function of time. As can be seen from FIG. 38, the average temperature of the ink within the 10 $\mu$m range from the surface of the heater reaches 70.9° C.

TABLE 1

STRUCTURE OF HEATING ELEMENT (HEATER)

| | | A | B (1) | B (2) | C |
|---|---|---|---|---|---|
| Anti-cavitation layer | Ta | 0.6 | 0.6 | 0.6 | — |
| | $Ta_2O_5$ | 0.05 | 0.05 | 0.05 | — |
| Protection layer | $SiO_2$ | 1 | 1 | 0.5 | — |
| Heating layer | $HfB_2$ | 0.065 | 0.065 | 0.065 | 0.065 |
| oxide layer | $SiO_2$ | 1.0 | 6.0 | 6.0 | — |
| Substrate | Si | 635 | 635 | 635 | — |
| Glass substrate | $SiO_2$ | — | — | — | 635 |

*All values are represented in units of μm.

The parameters employed in the specific embodiments and comparative examples as well as the results are summarized in Table 2. In Table 2, "CONV" in the column of "Driving method" refers to the conventional driving technique. In all cases in which the conventional driving technique is employed, the average temperature of the ink within the 10 μm range from the surface of the heater is 35 to 38° C. which is much lower than the desirable temperature of 70° C. The total quantity of heat applied to the ink is 0.3 to 0.4 μJ. In the comparative examples 1 to 3, the heat flux has a rather large value in the range from 200 to 240 MW/m$^2$. This results in creation of a bubble in the ink present near the surface of the heater before the ink within the 10 μm range from the surface of the heater can reach a sufficiently high temperature.

On the other hand, in the specific embodiments 1 to 8 according to the present invention, the ink can reach about 70° C. which is high enough for the purpose of the invention. In these specific embodiments, the total quantity of heat the ink receives is 1.2 to 1.3 μJ. The average heat flux in these embodiments is in the range from 40 to 80 MW/m$^2$. From the above results, the heat flux which should be generated in the driving method according to the present invention is roughly estimated as a half that generated in the conventional driving technique. More precisely, the heat flux can be determined as follows. For example, if it is assumed that $T_B$=300° C., $T_P$=70° C., $T_0$=25° C., the size of the heater is 24 μm×28 μm, the amount of ejected ink is 6.7 pl, and the coefficient of thermal conductivity and the specific heat are equal to those of water, then the average heat flux can be determined as 53 or less MW/m$^2$ by formula (11). This value of the average heat flux is in approximate agreement with those obtained in the specific embodiments 1 to 8 shown in Table 2. However, to obtain better agreement with these values, it is required to introduce a correction factor α for accommodating various unknown factors (not taken explicitly into account in the above model) in the heat conduction process.

$$q_o \leq \frac{\alpha\kappa\pi S(T_B - T_o)^2}{4V(T_P - T_o)} \tag{3}$$

The value of a is determined as about 1.5 by dividing the maximum of actual values for average heat flux 79.9 (obtained in Example 7) by the above-calculated heat flux value 53.

TABLE 2

VARIOUS PARAMETERS EMPLOYED IN EMBODIMENTS 1 TO 8 AND COMPARATIVE EXAMPLES 1 TO 3, AND RESULTS OBTAINED

| | Structure of the heating element (heater) | Driving method | Thickness of the protective layer μm | Driving voltage V | Period of time until a bubble is generated μS | Ultimate temperature of ink within 10 μm range from the surface of the heater ° C. | Width of the first pulse μS | Width of the second pulse μS |
|---|---|---|---|---|---|---|---|---|
| Comparative example 1 | (A) on a 1-μm oxide layer | conv. | 1.0 | 11.3 | 2.6 | 35.5 | 2.6 | — |
| Embodiment 1 | | 1-pulse | 1.0 | 5.7 | 24.0 | 69.7 | 24.0 | — |
| Embodiment 2 | | 2-pulse | 1.0 | 6.3 | 32.8 | 68.1 | 10.0 | 9.8 |
| Embodiment 3 | | 5-pulse | 1.0 | 7.5 | 28.8 | 69.5 | 5.6 | — |
| Comparative example 2 | (B) on a 6-μm oxide layer | conv. | 1.0 | 10.5 | 2.6 | 35.4 | 2.6 | — |
| Embodiment 4 | | 1-pulse | 1.0 | 4.0 | 28.0 | 69.8 | 28.0 | — |
| Embodiment 5 | | 2-pulse | 1.0 | 5.8 | 46.2 | 68.6 | 7.0 | 6.8 |
| Embodiment 6 | | | 0.5 | 5.3 | 40.6 | 67.0 | 7.0 | 6.6 |
| Comparative example 3 | (C) directly on a glass substrate | conv. | — | 6.5 | 2.6 | 38.1 | 2.6 | — |
| Embodiment 7 | | 1-pulse | — | 3.6 | 25.0 | 70.0 | 25.0 | — |
| Embodiment 8 | | 2-pulse | — | 4.0 | 40.0 | 70.9 | 10.0 | 9.2 |

| | Period of time during which the electric power is applied to the heater before a bubble is created μS | Amount of heat generated during the time period before the creation of a bubble μJ | Total amount of heat that the ink receives before a bubble is created μJ | Average heat flux for the time period before a bubble is created MW/m$^2$ |
|---|---|---|---|---|
| Comparative example 1 | 2.6 | 4.8 | 0.3 | 204 |
| Embodiment 1 | 24.0 | 11.4 | 1.3 | 79.4 |

TABLE 2-continued

VARIOUS PARAMETERS EMPLOYED IN EMBODIMENTS 1 TO 8 AND COMPARATIVE EXAMPLES 1 TO 3, AND RESULTS OBTAINED

| | | | | |
|---|---|---|---|---|
| Embodiment 2 | 19.8 | 11.5 | 1.2 | 57 |
| Embodiment 3 | 15.1 | 12.4 | 1.3 | 57.6 |
| Comparative example 2 | 2.6 | 4.1 | 0.3 | 196 |
| Embodiment 4 | 28.0 | 6.5 | 1.2 | 70.1 |
| Embodiment 5 | 13.8 | 6.8 | 1.2 | 40.1 |
| Embodiment 6 | 13.6 | 5.6 | 1.2 | 43.3 |
| Comparative example 3 | 2.6 | 1.6 | 0.4 | 237 |
| Embodiment 7 | 25.0 | 4.6 | 1.3 | 79.9 |
| Embodiment 8 | 19.2 | 4.5 | 1.3 | 47.8 |

The average temperature of ink in the 10 $\mu$m range from the surface of the heater has been discussed above so as to determine the upper limit of the average heat flux. With the increase in the average heat flux the total amount of heat that the ink can get during the period of time from the start of heating to the creation of a bubble decreases. This means that the calculation should be performed for the worst case in which the ink in the region on the heater is fully ejected (refer to Japanese Patent Application Laid-Open No. 4-109040 (1992), FIGS. 10 and 14). In the head having the structure shown in FIG. 2, the entire ink in the region on the heater is not always ejected. The optimum value of the average heat flux depends on the specific structure of the heating element and the nozzle. In any case, the optimum value is lower than that described above.

In the driving techniques described above in connection with specific embodiments, the driving methods using a single pulse, double pulses, and multi pulses are disclosed for example in Japanese Patent Laid-Open No. 5-31905 (1993). In contrast to the known techniques described above, the present invention provides the method of driving an ink-jet recording head which is essentially different from those known techniques in that recording is performed by using ink containing a polymer which shows a phase transition in response to application of heat without preheating a recording medium wherein the heat flux given from a heating element to ink is limited to a particular range so that ink can get a sufficient amount of heat to achieve a phase transition.

In the present invention, as described above, the process of fixing ink on a recording medium depends not only evaporation and penetration of ink but is controlled during the recording operation. As a result, it is possible to record a high-quality image with a high optical density without having feathering and bleeding.

Furthermore, in the present invention, the transition of state of the ink occurs only in response to the change in temperature. This means that even when the driving method is applied to other recording media other that paper, such as transparency films, cloths, or metal plates, the state transition occurs without being affected by the roughness of the surface of the recording media or the pH value.

Furthermore, in the present invention, ink can be effectively heated without having to use particular apparatus for preheating a recording medium.

Thus, the present invention is particularly useful when it is applied to an ink-jet recording apparatus.

What is claimed is:

1. An ink-jet recording method, comprising the steps of:

actuating a heating element having a surface and an effective area in a recording head in response to a recording signal, said heating element being in contact with an ink having a coefficient of thermal conductivity;

heating the ink by generating a heat flux from the surface of the heating element to the ink, thereby creating bubbles in the ink; and ejecting ink droplets having a volume from the head so that recording is effected with the ink droplets, on a recording medium, wherein said ink contains a water-soluble polymer and a coloring material, the water-soluble polymer comprising at least 50% by weight of an ester of vinyl-based carboxylic acid and an addition compound of an alkylene oxide having in its structure an alkylene oxide having a terminus to which a nitrogen-containing alicyclic group is bound, and wherein said ink is a liquid having a property such that its viscosity increases abruptly when heated and said heating element generates heat so that the heat flux $q_o$ from the surface of the heating element to the ink satisfies the following formula (3):

$$q_o \leq \frac{\alpha\kappa\pi S(T_B - T_o)^2}{4V(T_P - T_o)} \tag{3}$$

where $\kappa$ denotes the coefficient of thermal conductivity of the ink, S the effective area of the heating element, V the volume of ink droplets ejected by one driving operation, $T_B$ the temperature of the ink at which bubbles are created in the ink, $T_o$ the temperature of the ink before the ink is ejected, $T_p$ the transition temperature of the ink at which the abrupt change in the viscosity occurs, and $\alpha$ denotes a correction factor of 1.5.

2. The ink-jet recording method according to claim 1, wherein the viscosity of the ink changes in the range of from 35° C. to 100° C.

3. The ink-jet recording method according to claim 1, wherein the polymer has a weight-average molecular weight in the range of from 10,000 to 1,000,000.

4. The ink-jet recording method according to claim 1, wherein said heating element comprises a laminate including a heat generating resistor.

5. The ink-jet recording method according to claim 1, wherein said recording signal is an electrical signal in a pulse form.

6. An ink-jet recording method according to claim 1, wherein said coloring material is a dye.

7. An ink-jet recording method according to claim 1, wherein said coloring material is a pigment.

8. The ink-jet recording method according to claim 1, wherein the water-soluble polymer has 1 to 20 moles of alkylene oxide.

9. The ink-jet recording method according to claim 1, wherein the alkylene oxide is an ethylene oxide, propylene oxide or butylene oxide.

10. The ink-jet recording method according to claim 1, wherein the vinyl-based carboxylic acid is selected from the group consisting of acrylic acid, methacrylic acid, maleic acid and vinylbenzoic acid.

11. The ink-jet recording method according to claim 10, wherein the vinyl-based carboxylic acid is acrylic acid or methacrylic acid.

12. The ink-jet recording method according to claim 1, wherein the nitrogen-containing alicyclic group has an alicyclic ring selected from the group consisting of an aziridine ring, a pyrrolidine ring, a piperidine ring, a piperazine ring and a morpholine ring.

13. The ink-jet recording method according to claim 12, wherein the nitrogen-containing alicyclic group has a piperidine ring or a morpholine ring.

14. The ink-jet recording method according to claim 1, wherein the recording medium is put under conditions such that the recording medium is below the $T_p$.

* * * * *

UNITED STATES PATENT AND TRADEMARK OFFICE

CERTIFICATE OF CORRECTION

PATENT NO. : 5,943,080

DATED : August 24, 1999

INVENTOR(S) : HIDEMI KUBOTA, ET AL.

It is certified that error appears in the above-identified patent and that said Letters Patent is hereby corrected as shown below:

ON THE COVER PAGE:

Item [57] ABSTRACT

Line 19, "a" should read --α--.

COLUMN 1:

Line 45, "tend" should read --tending--.
Line 52, "pyrolidone" should read --pyrrolidone--.

COLUMN 2:

Line 24, "the ink" should read --of the ink--.
Line 26, "suppress" should read --suppresses--.
Line 60, "technique" should read --techniques--.

COLUMN 3:

Line 8, "ten or" should read --tens of--.
Line 14, "fifth" should read --six--.
Line 18, "problems" should read --problem--.

UNITED STATES PATENT AND TRADEMARK OFFICE

CERTIFICATE OF CORRECTION

PATENT NO. : 5,943,080

DATED : August 24, 1999

INVENTOR(S) : HIDEMI KUBOTA, ET AL.

It is certified that error appears in the above-identified patent and that said Letters Patent is hereby corrected as shown below:

COLUMN 4:

Line 14, "it" should read --it is--.
Line 32, "describes" should read --described--.

COLUMN 7:

Line 3, "obtain" should read --obtained--.
Line 4, "the" should read --a--.
Line 15, "polymer" should read --polymers--.
Line 16, "resolved" should read --dissolved--.
Line 17, "polymer" should read --polymers--.
Line 41, "require" should read --require that--.
Line 46, "such the" should read --such a--.
Line 50, "such the" should read --such a-- and "types inks" should read --types of inks--.

COLUMN 8:

Line 7, "an" should read --a--.
Line 13, "the" should read --a--.

UNITED STATES PATENT AND TRADEMARK OFFICE

CERTIFICATE OF CORRECTION

PATENT NO. : 5,943,080

DATED : August 24, 1999

INVENTOR(S) : HIDEMI KUBOTA, ET AL.

It is certified that error appears in the above-identified patent and that said Letters Patent is hereby corrected as shown below:

COLUMN 9:

Line 5, "2-pyrolidone" should read --2-pyrrolidone--.
Line 60, "2-pyrolidone," should read --2-pyrrolidone,--.

COLUMN 11:

Line 43, "preferably-contain" should read --preferably contain--.

COLUMN 12:

Line 12, "However," should read --However, they--.
Line 33, "employ" should read --to employ--.

COLUMN 13:

Line 6, "dying" should read --dyeing--.
Line 16, "group amino" should read --group, amino--.
Line 31, "denaturazation" should read --denaturized--.
Line 36, "denaturazation" should read --denaturized-- and "an" should read --a--.
Line 49, "an" should read --a--.

UNITED STATES PATENT AND TRADEMARK OFFICE

CERTIFICATE OF CORRECTION

PATENT NO. : 5,943,080

DATED : August 24, 1999

INVENTOR(S) : HIDEMI KUBOTA, ET AL.

It is certified that error appears in the above-identified patent and that said Letters Patent is hereby corrected as shown below:

COLUMN 14:

Line 7, "N-methyl-2-pyrolidone," should read --N-methyl-2-pyrrolidone,--.

Line 9, "2-pyrolidone," should read --2-pyrrolidone,--.

Line 26, "1,3-propanesultone;" should read --1,3-propanesulfone;--.

Line 38, "2-pyrolidone; N-methyl-2-pyrolidone;" should read --2-pyrrolidone; N-methyl-2-pyrrolidone;--.

COLUMN 15:

Line 2, "an" should read --a--.

Line 44, "ten" should read --tens of--.

Line 52, "X" should read --x--.

COLUMN 16:

Line 13, "created-before" should read --created before--.

UNITED STATES PATENT AND TRADEMARK OFFICE

CERTIFICATE OF CORRECTION

PATENT NO. : 5,943,080

DATED : August 24, 1999

INVENTOR(S) : HIDEMI KUBOTA, ET AL.

It is certified that error appears in the above-identified patent and that said Letters Patent is hereby corrected as shown below:

COLUMN 17:

Line 1, "shown" should read --taken along line--.
Line 24, "65" should read --65.--.
Line 32, "61," should read --61.--.

COLUMN 19:

Line 38, "an" should read --a sufficient--.
Line 39, "enough" should be deleted.

COLUMN 20:

Line 22, "specifically.," should read --specifically,--.
Line 44, "lower" should read --lower than--.

COLUMN 23:

Line 11, Table 1, "oxide" should read --Oxide--.

UNITED STATES PATENT AND TRADEMARK OFFICE

CERTIFICATE OF CORRECTION

PATENT NO. : 5,943,080

DATED : August 24, 1999

INVENTOR(S) : HIDEMI KUBOTA, ET AL.

It is certified that error appears in the above-identified patent and that said Letters Patent is hereby corrected as shown below:

COLUMN 26:

Line 7, Table 2, "57.6" should read --67.6--.

Signed and Sealed this

Twenty-ninth Day of August, 2000

*Attest:*

*Attesting Officer*

Q. TODD DICKINSON

*Director of Patents and Trademarks*